US010360888B2

(12) United States Patent
Boyd

(10) Patent No.: US 10,360,888 B2
(45) Date of Patent: Jul. 23, 2019

(54) MUSICAL INSTRUMENT

(71) Applicant: Annie Rose Boyd, Kalbarri (AU)

(72) Inventor: Annie Rose Boyd, Kalbarri (AU)

( * ) Notice: Subject to any disclaimer, the term of this patent is extended or adjusted under 35 U.S.C. 154(b) by 0 days.

(21) Appl. No.: 16/098,551

(22) PCT Filed: May 18, 2016

(86) PCT No.: PCT/IB2016/052884
§ 371 (c)(1),
(2) Date: Nov. 2, 2018

(87) PCT Pub. No.: WO2017/199064
PCT Pub. Date: Nov. 23, 2017

(65) Prior Publication Data

US 2019/0147839 A1 May 16, 2019

(51) Int. Cl.

| | |
|---|---|
| ***G10H 1/055*** | (2006.01) |
| ***G10H 1/34*** | (2006.01) |
| ***G10D 7/02*** | (2006.01) |

(52) U.S. Cl.
CPC ..... *G10H 1/055* (2013.01); *G10D 7/02* (2013.01); *G10H 1/344* (2013.01);
(Continued)

(58) Field of Classification Search
CPC .. G10H 1/055; G10H 1/344; G10H 2220/275; G10H 2220/361; G10H 2230/195; G10D 7/02
(Continued)

(56) References Cited

U.S. PATENT DOCUMENTS 594,735 A * 11/1897 Giorgi ..... G10D 7/026 84/384
2,301,184 A * 11/1942 Arnold ..... G10H 1/32 84/742
(Continued)

FOREIGN PATENT DOCUMENTS

| | | | |
|---|---|---|---|
| GB | 254395 | 7/1926 | |
| GB | 2 040 097 A | 8/1980 | |
| GB | 2040097 A * | 8/1980 | ..... G10D 7/02 |

*Primary Examiner* — David S Warren
*Assistant Examiner* — Christina M Schreiber
(74) *Attorney, Agent, or Firm* — Birch, Stewart, Kolasch & Birch, LLP

(57) ABSTRACT

A musical instrument comprising a mouthpiece and an elongated body, the elongated body comprises a plurality of finger contacts. The finger contacts comprise a first set of contacts arranged such that they may be simultaneously contacted by the little, ring, middle and index finger of the right hand and a second set of contacts arranged such that they may be simultaneously contacted by the little, ring, middle and index finger of the left hand. It further comprises a first thumb contact for contact by the right thumb and a second thumb contact for contact by the left thumb. The instrument comprises a tone generator controlled by the plurality of contacts, such that a first set of successive half tones is generated under control of the second set of contacts when the first thumb contact is operated, a second set of successive half tones is generated under control of the first set of contacts when the second thumb contact is operated, a third set of successive half tones is generated under control of the second set of contacts when the first thumb contact is freed; and a fourth set of successive half tones is generated under control of the first set of contacts when the second thumb contact is freed.

24 Claims, 11 Drawing Sheets

(52) U.S. Cl.
CPC ..... *G10H 2220/275* (2013.01); *G10H 2220/361* (2013.01); *G10H 2230/195* (2013.01)

(58) Field of Classification Search
USPC ..... 84/609
See application file for complete search history.

(56) References Cited

U.S. PATENT DOCUMENTS 3,326,073 A * 6/1967 Tremaine ..... G10D 7/023 84/380 C
3,767,833 A * 10/1973 Noble ..... G10H 1/00 84/673
3,888,154 A * 6/1975 Wesley, Sr. ..... G10D 7/02 84/384
4,206,680 A * 6/1980 Hanson ..... G10D 7/066 84/382
4,664,011 A * 5/1987 Strathmann ..... G10D 9/043 84/384
4,763,556 A * 8/1988 Peplowski ..... G10D 9/00 84/384
5,300,729 A * 4/1994 Tokunaga ..... G10H 1/02 84/619
5,403,966 A * 4/1995 Kawashima ..... G10H 1/0553 84/612
5,453,571 A * 9/1995 Adachi ..... G10H 1/053 84/626
5,922,985 A * 7/1999 Taniwaki ..... G10H 1/34 84/742
5,929,361 A * 7/1999 Tanaka ..... G09B 15/003 84/380 R
6,538,189 B1 * 3/2003 Ethington ..... G10H 1/34 84/615
7,723,605 B2 * 5/2010 Gremo ..... G10H 1/344 84/615
7,829,780 B2 * 11/2010 Onozawa ..... G10D 7/00 84/385 R
7,851,685 B2 12/2010 Reiβner
2009/0020000 A1 * 1/2009 Onozawa ..... G10D 7/00 84/723
2016/0019872 A1 * 1/2016 Tanabe ..... G10D 7/026 84/384
2016/0035327 A1 * 2/2016 Allen ..... G10D 7/08 84/385 R

* cited by examiner

MUSICAL INSTRUMENT

TECHNICAL FIELD

The invention relates to a musical instrument comprising a mouthpiece and an elongated body connected to the mouthpiece, the elongated body comprising a plurality of finger contacts.

BACKGROUND ART

Woodwind instruments have been known for a long time. The modern instruments such as concert flutes, oboes, clarinets, bassoons, saxophones and other members of these instrument families feature a sound tube provided with a certain number of holes. The holes are covered by the finger of the player or by pads that are operated directly or indirectly by the fingers of the player. The number of holes of modern instruments exceeds the number of fingers in order to enable chromatic playing as well as to improve intonation, facilitate trills, etc. With some instruments, not all fingers are available for the operation of tone holes or keys as they are used to hold the instrument. Accordingly a key mechanism is required that allows for closing all the tone holes with the fingers available for operating the keys.

Today, widely established key mechanisms are available such as the Boehm system of concert flutes, the systéme conservatoire of oboes, the Boehm and Oehler systems of clarinets, the Heckel and Buffet systems of bassoons as well as the modern saxophone key work. However, these mechanisms have their drawbacks: First of all, with all of these mechanisms fingers have to operate several keys. As an example, when playing a contemporary bass clarinet extending to low C, the right and left little finger are responsible for operating six keys each. Even more keys are operated by the left thumb of a bassoonist. Furthermore, so-called "forked" fingerings, i. e. fingerings where a certain tone hole is open and at least one adjacent lower tone hole is closed, are required for some of the notes, even in the fundamental registers of the instruments. They impede fluid playing of the instrument and are counter-intuitive. All this contributes to some keys (especially those having a large number of accidentals) being more difficult to play than others. Learning to play fluidly in all keys is therefore cumbersome. Furthermore, modern music that is not bound to traditional tonality is even more difficult to play on today's instruments.

It has been approached to modify the established instruments and their key mechanisms to address the aforementioned problems.

As an example, U.S. Pat. No. 7,851,685 B2 (E. Reissner) relates to an improvement of the fingering mechanism for woodwind instruments, in particular for oboes. The document is directed to avoid the problems that occur in connection with the forked fingerings of the known fingering systems. It proposes to have a fingering mechanism that comprises a first key that actuates both a first hole corresponding to the first key, and another remote tone hole. By closing the first key corresponding to the first tone hole, the first tone hole is closed only if a second tone hole that is closer to the mouthpiece is closed as well. In order to allow this, the first tone hole is modified in such a way that it is not directly actuated by the first key but via an intermediary mechanism. This may be achieved by placing the first tone hole not directly below the first key but in a position that is rotated with respect to the first key along the circumference of the tube of the instrument. A second mechanism prevents the first tone hole from being closed if the second tone hole is open. With respect to the Systeme Conservatoire of the oboe, the disclosure allows for avoiding the forked fingerings at Bb4 and C5. The measure is declared to be applicable not only to oboes but also to concert flutes, clarinets, oboe d'amore, English horn, bassoons and saxophones.

The measure proposed by the Reissner patent alleviates a specific problem of a specific mechanism. It does not aim at solving the general problems stated above.

GB 2 040 097 B2 (A. D. Freed) relates to improvements to the support, fingering and mechanism of instruments of the flute family. Inter alia it seeks to provide improved support allowing a natural position of head and arms. For that purpose, the tube of the instrument is arranged as a loop, wherein the tone hole row is disposed diametrically opposite the excitation aperture. In particular, the tone hole rows are located in two arms of a V-shaped portion of the instrument. Further, a palm rest is proposed that is attached to or near each of the arms so that the instrument can be supported in the palms which are pressed inwards towards each other to react against the two palm rests. This ensures that the fingers are not involved in support and all ten digits are available to operate holes or keys.

The palm rests allow for using all ten fingers for controlling keys even when playing concert flutes. Besides this, the further problems of known instruments and their key mechanisms are not solved.

GB 254,395 (J. W. McAvoy) relates to an improvement of woodwind instruments such as flutes, oboes, clarinets, bassoons or saxophones. The proposed instrument has an arrangement of bar levers or multiple levers that control a number of the independent pad levers and/or auxiliary levers, whereas these bar levers may be selectively out of action or in action. The bar levers are provided with extensions lying in the reach of the player's fingers. Specifically, a flute having 16 tone holes is described. The right hand fingers control pad levers and auxiliary levers, the left hand fingers control pad levers and auxiliary levers. Furthermore, three bar levers are provided. The bar levers lie over pad levers, so that when a bar lever is depressed by a finger piece extension said pad levers are all depressed, which allows for operating the adjacent auxiliary levers by the respective hand (controlling additional holes). A further bar lever on the other side of the tone holes is normally raised, it may be operated using extensions by the left thumb or the right index finger, respectively. Operating the bar lever opens the additional holes allowing for operating the auxiliary levers of the right hand (controlling the additional holes). This allows for controlling any number of pad levers and/or auxiliary levers at one time by one finger or thumb and for transposing without having to change the fingering. Furthermore, forked fingerings are avoided.

This design approaches some of the aforementioned problems. However, the fingers still need to move between different contacts (such as main levers and auxiliary levers) and the operation of bar levers is unfamiliar to woodwind players.

SUMMARY OF THE INVENTION

It is the object of the invention to create a musical instrument pertaining to the technical field initially mentioned that allows for fluid playing irrespective of key.

The solution of the invention is specified by the features of claim 1. According to the invention a) the plurality of finger contacts comprises a first set of contacts that are arranged in such a way that they may be simultaneously contacted by the little finger, ring finger, middle finger and index finger of the right hand;

b) the plurality of finger contacts comprises a second set of contacts that are arranged in such a way that they may be simultaneously contacted by the little finger, ring finger, middle finger and index finger of the left hand;

c) the plurality of finger contacts comprises a first thumb contact that may be contacted by the thumb of the right hand simultaneously with the finger contacts of the first set of contacts;

d) the plurality of finger contacts comprises a second thumb contact that may be contacted by the thumb of the left hand simultaneously with the finger contacts of the second set of contacts;

e) the musical instrument comprises a tone generator controlled by the plurality of finger contacts, in such a way that a first set of successive half tones are generated under control of the second set of contacts when the first thumb contact is operated;

a second set of successive half tones are generated under control of the first set of contacts when the second thumb contact is operated, a third set of successive half tones are generated under control of the second set of contacts when the first thumb contact is freed; and a fourth set of successive half tones are generated under control of the first set of contacts when the second thumb contact is freed.

The instrument features ten finger contacts that are operated by the ten fingers of the player. The ten contacts are arranged in such a way that they may be simultaneously contacted by the ten fingers, i. e. that there is a 1:1 assignment, and that they may be independently operated.

The elongated body has a form that allows for arranging the finger contacts along the body or parts of it. It does not need to be a straight tube (similar to sound tubes of flutes, oboes or soprano clarinets) but may feature e. g. a plurality of straight tubes (similar to sound tubes of bassoons) and/or curved sections (similar to sound tubes of curved saxophones).

As described in more detail further below, the tone generator may be a sound tube, i. e. part of an acoustic instrument. In that case, a vibrating air column in the sound tube is generated by the mouthpiece (which may be in particular a flute, single or double reed mouthpiece), and the sound tube comprises a number of tone holes covered by pads that are operated by means of the finger contacts.

In other embodiments, the tone generator is an electronic tone generator such as an analogue or digital synthesizer. In this case, the mouthpiece is a wind controller mouthpiece providing control signals for the electronic tone generator. Furthermore, in this case, the tone generator may be a separate unit that is not mechanically linked to the elongated body.

On the one hand, using all ten fingers to control respective finger contacts increases the possibilities of controlling the tone generator, namely of choosing the pitch of the tone to be generated. On the other hand, having exactly ten finger contacts assigned to the ten fingers avoids the need for controlling several contacts by a given finger, which requires the changing of a contact operated by the finger by repositioning the finger or sliding to another contact.

Certain woodwind instruments are known which allow and require the use of all ten fingers for operating keys, e. g. the bassoon or the bass clarinet. In connection with other instruments, there are several measures that may be taken in order to enable all the ten fingers to control respective contacts, such as using additional holding mechanisms (as described in more detail below for the case of the concert flute), using straps or stands.

The musical instrument according to the invention features a fingering regime that permits ten fingers and thumbs to control the generation of a series of at least sixteen half tones, and do so easily. Using the thumb contacts, the usefulness of the other fingers is multiplied due to a novel co-operation between the playing hands: specifically, between the fingers of the left hand and the thumb of the right hand, and between the fingers of the right hand and the thumb of the left hand. The practical effect is that finger technique learned for one part of the scale may be reapplied at another part of the scale.

Preferably, in a given register a pitch range defined by the fourth set of successive half tones is above a pitch range defined by the third set of successive half tones, which is above a pitch range defined by the second set of successive half tones, which is above a pitch range defined by the first set of successive half tones.

In this context, the term "register" relates to a series of notes covering a certain pitch range. With an acoustic instrument, the notes of a given register may be generated on the basis of a certain harmonic of the harmonic series, by opening or closing tone holes—according to a certain sequence of fingerings. Generally, there is the fundamental register and several "overblown" registers ($2^{nd}$ $3^{rd}$, $4^{th}$ harmonics etc.). As an example, the flute, oboe or saxophone overblows at an octave ($2^{nd}$ harmonic=$2^{nd}$ register), whereas the clarinet, being a closed pipe instrument of cylindrical bore, overblows at a perfect $12^{th}$ ($3^{rd}$ harmonic=$2^{nd}$ register).

The notion of a "register" is conveyed to the non-acoustic instrument ("wind controller"), denoting a series of notes that are played using a certain sequence of fingerings.

The aforementioned succession of pitch ranges, i. e. from low to high: $1^{st}$ set (left hand)-$2^{nd}$ set (right hand)-$3^{rd}$ set (left hand)-$4^{th}$ set (right hand), provides an intuitive fingering scheme, where at least the middle section ($2^{nd}$ and $3^{rd}$ set) bears some similarities with that of the commonly used fingering schemes of woodwind instruments.

In first embodiments of instruments according to the invention, the elongated body is a sound tube, the mouthpiece is a woodwind mouthpiece for generating a vibrating air column in the sound tube and the plurality of finger contacts are linked to pads for covering tone holes in the sound tube.

The mouthpiece and sound tube may essentially correspond to those of existing woodwind instruments such as flutes, oboes, clarinets, saxophones etc. Nevertheless, completely different designs are possible as well. In all cases, the first (fundamental) and second registers will be the same or very similar. But for acoustical reasons the third-register fingerings will need to be different.

The finger contacts may be linked to the pads by common mechanical means (linkages) but also by pneumatic or hydraulic means or by a signal connection. In the latter case, the pads will be actuated by assigned actuators. Different approaches may be used in a single instrument.

Preferably, additional half tone steps are provided by the operation of each of the first and the second thumb contacts.

In the context of an acoustic instrument, the sound tube thus comprises at least 18 tone holes, the closure of which is operated by the first set of contacts, the second set of contacts, the first thumb contact and the second thumb contact, wherein each finger contact of the first set of contacts and each finger contact of the second set of contacts operates two tone holes, depending on a state of the second thumb contact or the first thumb contact, respectively, and wherein the first thumb contact and of the second thumb contact operate a further tone hole each.

This allows for controlling 18 tone holes by the ten finger contacts. These 18 tone holes corresponding to 18 half tones cover a range of a perfect $12^{th}$ (19 semitones). This makes the application of the inventive fingering scheme to the clarinet particularly beneficial. As mentioned before, the clarinet's $2^{nd}$ register is a perfect $12^{th}$ (19 semitones) higher than the first (fundamental) register, i. e. a note of the $2^{nd}$ register having (substantially) the same fingering as a note of the first register is a perfect $12^{th}$ higher than the first register note. Correspondingly, 18 tone holes are needed to cover the range of the fundamental register. The fingering scheme according to invention allows for controlling the closing of these 18 tone holes in an efficient and ergonomic way, and the next register connects seamlessly.

It is to be noted that the clarinet (and other woodwind instruments) usually requires a register key, usually a further hole (or two or more further holes) that is opened to ensure that the notes of the second register sound instead of the notes of the fundamental register. Usually the lowest mode is suppressed because the further hole creates a pressure node and is situated at a point where the mode to be suppressed would produce a significant pressure variation.

As shown in more detail below, a further key for opening and closing the hole(s) required for the register change may be implemented in an inventive instrument e. g. by employing a thumb key with two or more sections.

Preferably, a pitch of a first of the additional half tone steps (provided by a thumb contact) is between the second and third set of successive half tones and a pitch of a second of the additional half tone steps (provided by the other thumb contact) is between the third and the fourth set of successive half tones. This is the most intuitive arrangement and facilitates the construction of purely acoustic musical instruments according to the invention because the tone holes for generating the additional half tone steps will be arranged immediately above the second set and immediately above the third set of tone holes which coincides with the position of the thumbs with respect to the fingers operating the keys assigned to the tone holes of the second and third set.

Preferably, in an acoustic instrument according to the invention, a first set of tone holes corresponding to the first set of successive half tones is arranged below a second set of tone holes corresponding to the second set of successive half tones, which is arranged below a third set of tone holes corresponding to the third set of successive half tones, which is arranged below a fourth set of tone holes corresponding to the fourth set of successive half tones.

In the following, when referring to the sound tube of an acoustic instrument, "high" refers to a position closer to the mouthpiece, whereas "low" refers to a position further away from the mouthpiece. Accordingly, starting from the open end of the sound tube (away from the mouthpiece) the succession of tone holes is as follows: $1^{st}$ set-$2^{nd}$ set-$3^{nd}$ set-$4^{th}$ set.

Advantageously, the first set of contacts is arranged in a region essentially corresponding to a position of the second set of tone holes and the second set of contacts is arranged in a region essentially corresponding to a position of the third set of tone holes. In such an embodiment, the sets of tones holes may be characterised as follows:

$1^{st}$ set: remote tone holes, controlled by the fingers of the left hand ("left hand remote");

$2^{nd}$ set: local tone holes, controlled by the fingers of the right hand ("right hand local");

$3^{rd}$ set: local tone holes, controlled by the fingers of the left hand ("left hand local");

$4^{th}$ set: remote tone holes, controlled by the fingers of the right hand ("right hand remote").

Preferably, the first thumb contact is linked to the pads in such a way that operating the first thumb contact simultaneously closes all tone holes of the third set of tone holes independent of the actuation of the second set of contacts, and in that the second thumb contact is linked to the pads in such a way that operating the second thumb contact simultaneously closes all tone holes of the fourth set of tone holes, independent of the actuation of the first set of contacts.

In the following, preferred aspects of an acoustic embodiment of an instrument according to the invention are illustrated using the example of a concert flute and comparing this example to the usual Boehm flute.

The concert flute according to the invention features a usual head joint as well as a sound tube with tone holes and key work that is built according to the invention. The sound tube features 18 tone holes, denoted by the numbers 1-18, the distance of two adjacent tone holes always corresponding to a semitone. The note where all tone holes are closed is denoted by 0, for the further notes, the number of the lowest open tone hole indicates the number of the note. For the described concert flute, the note 0 is A#3 (a whole step below middle C), accordingly the note 18 (all tone holes open, highest note of the fundamental register) is E5.

The fundamental register of the usual Boehm flute ends with a small hole that blows C#5 and C#6, and serves as a vent hole for several other notes. It is well known that for any note played on a wind instrument, the end of the vibrating air column does not coincide with the location of the first open tone hole, but occurs some distance beyond the open hole. The distance from the centre of the tone hole to the effective end of the air column is usually referred to as the "end correction". For the note to play in tune, the "terminal" hole must therefore be placed higher on the instrument, by an amount equal to the end correction. But when the same hole is called into service as a vent hole for another note, no end correction applies. It should be placed as close as possible to a pressure node of the vibrating air column.

In most situations, this problem is inescapable. On the Boehm flute, all notes from D#6-G#6 are played as 4th harmonics using vent holes that are 10-15 mm higher than their ideal positions. All of these notes play sharp, and F#6 and G#6 have other problems that make them sharper still.

Significantly, this problem does not affect the note D6 on a Boehm flute. Boehm realised that if the C#5 hole were reduced in size, and shifted higher on the instrument, it could be placed very close to where a D5 vent would be required. He exploited this displacement for several notes, including D6 and A6. Boehm understood that the idea could be taken further by adding extra holes. However, due to the mechanical complexity involved with doing so Boehm did not pursue this idea further.

Where the Boehm flute has only the C#5 hole, an acoustic flute according to the invention has four holes C#5 (15), D5 (16), D#5 (17) and E5 (18). Despite the fact that in the context of a flute (and opposed to the clarinet) the "extra" holes 15-18 are not required to ensure a seamless connection to the next register, the further holes are of great value, as explained in the following.

From the bottom of a wind instrument to the top, the spacing of the tone holes steadily decreases (because the notes of a musical scale are related geometrically rather than arithmetically). In the range C#5-E5 ("extra" holes 15-18) on the inventive flute the spacing of the semitones becomes very similar to the end correction of a typical tone hole. By careful sizing, tone holes in this range can be made to fall very near a pressure node corresponding to the next-higher note in the scale.

On the inventive flute, a carefully sized and placed C#5 hole (15) acts as the terminal hole for C#5 and C#6, and also as a near-perfect vent hole for notes that would otherwise call for venting at D5. Similarly, new holes at D5 (16), D#5 (17) and E5 (18) serve as vent holes for notes that would otherwise call for venting one semitone higher. All in all, the intonation of the affected notes is greatly improved.

Preferably, at least one of the first and second thumb contact comprises two sections that may be operated together or independently by the associated thumb, wherein operating one of the two sections allows for closing the tone holes of a set of half tones associated with the thumb contact without simultaneously closing a further single tone hole associated with the thumb contact.

This allows for decoupling the two functions of the thumb contact, namely closing the corresponding tone hole and switching between different sets of tone holes that are closed by actuating finger contacts by the other hand of the player. This decoupling is important in particular if the instrument is played in higher registers, where the sounding of higher partials is facilitated by the opening of vent holes to discourage the production of lower partials (vented harmonics). Separation of the two functions of the thumb contacts allows for an increased set of tone hole configurations in higher registers (especially in the $3^{rd}$ and higher registers).

In particular, within a divided left-hand thumb assembly:

a lower part acts only upon the left thumb hole;

an upper part acts upon the next four holes toward the top of the instrument, namely, the right-hand remote group.

Preferably, a central section is foreseen that activates both parts and acts upon all five holes.

Similarly, within a divided right-hand thumb assembly:

a lower part acts only upon the right thumb hole;

an upper part acts upon the next four holes toward the top of the instrument, namely, the left-hand local group.

Again, preferably a central section is foreseen that activates both parts and acts upon all five holes.

In preferred embodiments, sliding between the two parts of the thumb contact is only required in higher registers. In the fundamental register (and possibly the $2^{nd}$ register) all notes may be played by contacting the central section of the thumb contact, i. e. all fingers (including the thumbs) will always interact with the same finger contacts.

It is to be noted that in principle a corresponding thumb contact may comprise more than two sections in order to provide even greater flexibility, if required.

Furthermore, it is to be noted that a corresponding thumb contact, comprising two sections that may be operated together or independently by the associated thumb and preferably having one or several of the features discussed in the following, may be very beneficial also in instruments, especially woodwind instruments, that are not built according to the invention, i. e. that do not feature the fingering scheme described above. Furthermore, such a contact may be adapted for actuation by other fingers.

Preferably, the two sections are constituted by two elements that are depressible independently of each other, the elements providing an essentially planar actuating surface, wherein in an idle state of both sections the actuating surfaces of the two sections lie in a common plane.

This allows for a simple build-up of the thumb contact and for an easy sliding movement between the two sections.

More preferably, the actuating surfaces of the elements feature an opening each and the first of the elements is connected to a first auxiliary section associated with the opening of the second of the elements and the second element is connected to a second auxiliary section associated with the opening of the first element. The first auxiliary section penetrates the opening of the second element when the second element is depressed and the first element is idle and the second auxiliary section penetrates the opening of the first element when the first element is depressed and the second element is idle.

The auxiliary sections penetrating the opening of a depressed element support the sliding movement of the player's thumb from the depressed element to the adjacent non-depressed (i. e. "higher") element.

Preferably the auxiliary sections are ramp-shaped, an elevation of the auxiliary sections rising in a direction towards the element connected to the respective auxiliary section. Accordingly, as soon as the thumb has reached the outer end of the ramp further sliding of the thumb towards the other element will gradually lower the other element. Accordingly, when the inner end of the ramp is reached the actuating surface of the other element will be essentially level with the actuating surface of the first element. Accordingly, the step between the two elements is eliminated.

Preferably, the first element and first auxiliary section, and the second element and second auxiliary section, respectively, are unitary components. This allows for a simple and rigid build-up of the thumb contact with a minimum of additional parts.

In a preferred embodiment, the first element and the second element are pivotable about a common axis. Again, this is a simple and reliable design of a divided thumb contact.

In a preferred embodiment, the instrument has a linkage mechanism for mechanically transmitting an operation of at least two of the plurality of finger contacts to at least two of the pads for covering tone holes, wherein the linkage mechanism comprises at least two linkage bars having a helix-shaped section, the helix-shaped section of a first of the at least two linkage bars and the helix-shaped section of a second of the at least two linkage bars being intertwined.

More than two such linkage bars may be employed. In the context of an acoustic instrument according to the invention, four intertwined linkage bars may be used in order to mechanically transmit operation of four finger contacts to the pads of the corresponding remote group of tone holes. In contrast to usual coaxial mechanisms having an inner rotating shaft and an outer rotating sleeve, the number of links is not critical—the linkage bars are not organised one-inside-another but one-beside-another. Furthermore, the usual challenges of such coaxial mechanisms, namely unwanted interaction between the shaft and the sleeve, are avoided, without the need for strong return springs.

It is to be noted that application of the linkage mechanism having intertwined helix-shaped sections is not restricted to the inventive flute having the fingering scheme described above, but it may be very beneficial also in instruments, especially woodwind instruments that are not built according to the invention.

Preferably, the at least two linkage bars each comprise a first linear section and a second linear section collinear with the first linear section, the first linear section neighbouring the respective finger contact and the second linear section neighbouring the respective pad, the helix-shaped section being arranged in between the first and the second linear section, wherein the first linear section of the first linkage bar is parallel to the first linear section of the second linkage bar and the second linear section of the first linkage bar is parallel to the second linear section of the second linkage bar. The first linear section and the second linear section may be immediately adjacent to the finger contact or pad, respectively, or further elements may be arranged in between the linkage bar and the mentioned elements.

Preferably, the linkage mechanism features a central bar, the first and second linear sections of the at least two linkage bars being pivotably attached to the central bar, the helix-shaped section of the at least two linkage bars running around the central bar. This allows for a stable build-up of the mechanism. It is not required that the central bar extends through the entire section with the intertwined helix-shaped sections, but it may comprise e. g. two collinear sections in the regions of the linear sections of the linkage bars.

The linear sections as well as the helix-shaped section may be supported on the central bar (of circular cross-section) by means of sleeves surrounding the central bar. Thus, a plain bearing between the inner surface of the sleeves and the outer surface of the central bar is created.

Preferably, the helix-shaped section of at least one of the linkage bars comprises at least two linkage components joined by an adjustable screw connection. This allows for an accessible and logical positioning of the adjustment mechanisms, such that the links provided by the linkage bars may be easily adjusted.

Preferably, the first linear section comprises a limiting stop for limiting a transmission of an actuating force to the helix-shaped section. Due to the helix-shaped sections, the torsional stiffness of the linkages is less than that of straight linkage bars. The use of the limiting stop avoids excessive torsional forces acting on the linkage. Excess pressure is absorbed by the stop and not transmitted along the linkage. Furthermore, forces acting on the connected pad are limited as well, which may extend the service life of the pad. This is why corresponding limiting stops may be advantageous also with linkages that do not feature helix-shaped sections.

Preferably, the motion of each finger contact is limited by the limiting stop in both directions. The stop may comprise a fixed element connected to the elongated body of the instrument and a counterpart element connected to the first linear section, wherein the counterpart element interacts with the fixed element as soon as one of the desired stops limiting the action of the finger contact is reached. The fixed element and/or the counterpart element may feature an elastic material in order to reduce noise and to ensure smooth operation.

In a preferred embodiment of the invention, connections between the ten finger contacts to local and remote holes are mechanically very similar. Certainly, the remote connections include the helix-shaped section and have their screw-adjustment clutches in different locations, but all linkages operate in the same way, i. e.

none is rigidly linked to the cup and pad; and all use a lever stop to prevent excess finger pressure being transmitted to the pad, and a screw-adjustment clutch to set the pad pressure.

In a preferred embodiment of the invention, a plurality of sensors is assigned to the plurality of finger contacts in such a way that first signals are generated representing the actuation of the finger contacts and in that the tone generator is controlled by the first signals.

This is applicable in particular to a) an acoustic instrument with electrically controlled pads; and b) a wind controller instrument as described in more detail below.

Having electrically controlled pads allows for extending the basic fingering sequence to a larger pitch range than just the fundamental and $2^{nd}$ register (covering e. g. 30 semitones in the case of a flute), in particular to essentially the whole range of the instrument (44 semitones or more). For each fingering, the optimum combination of open and closed holes may be chosen.

Accordingly, a musical instrument comprising a sound tube and a woodwind mouthpiece for generating an air column in the sound tube, wherein the sound tube comprises a number of tone holes that are closed by electrically controlled pads, controlled by a number of finger contacts offers additional advantages, in particular in connection with the fingering scheme described above but in principle also in connection with other fingering schemes. In principle, partial closing of holes (by lowering the respective pads) for fine-tuning the intonation and/or sound of the instrument is possible as well if the mechanism used for closing the pads so permits.

In principle, the sensors may provide simple binary signals (on/off). However, in order to ensure reliable control of the instrument, the sensors preferably provide first signals of higher information content, e. g. signals that can take on three or more discrete values or even analogue signals. First signals relating to a given finger contact may be delivered by a single sensor or by two or more sensors.

An embodiment of the inventive musical instrument features a wind controller mouthpiece generating second signals representing the air-controlled operation of the musical instrument, wherein the tone generator is a synthesizer that is controlled by the first and second signals.

In a manner known as such, the second signals delivered by the wind controller mouthpiece may be a measure for the wind pressure, the lip pressure exerted onto the mouthpiece and/or the vibrations generated in the mouthpiece (or an adjacent section of tube, respectively). The second signals may be digital and/or analogue signals.

The synthesizer may be controlled directly by the musical instrument or indirectly by means of a processor processing the first and second signals. As an example, the signals delivered to the synthesizer may be MIDI signals.

Preferably, the inventive musical instrument comprises two hand supports extending from the elongated body, the hand supports allowing for supporting the elongated body by the two hands of a player, in such a way that all ten fingers of the player may independently actuate the plurality of finger contacts. These hand supports are useful in connection with instruments that do not feature a stand and that cannot be easily supported by means of a neck strap or harness, such as the concert flute.

Advantageously, the hand supports comprise a contact piece to be pressed into a palm of an associated hand of the player.

Other advantageous embodiments and combinations of features come out from the detailed description below and the totality of the claims.

BRIEF DESCRIPTION OF THE DRAWINGS

The drawings used to explain the embodiments show.

In the figures, the same components are given the same reference symbols.

PREFERRED EMBODIMENTS

In the following, an embodiment of the invention is described. The described instrument is an acoustic concert flute.

Figure 1:
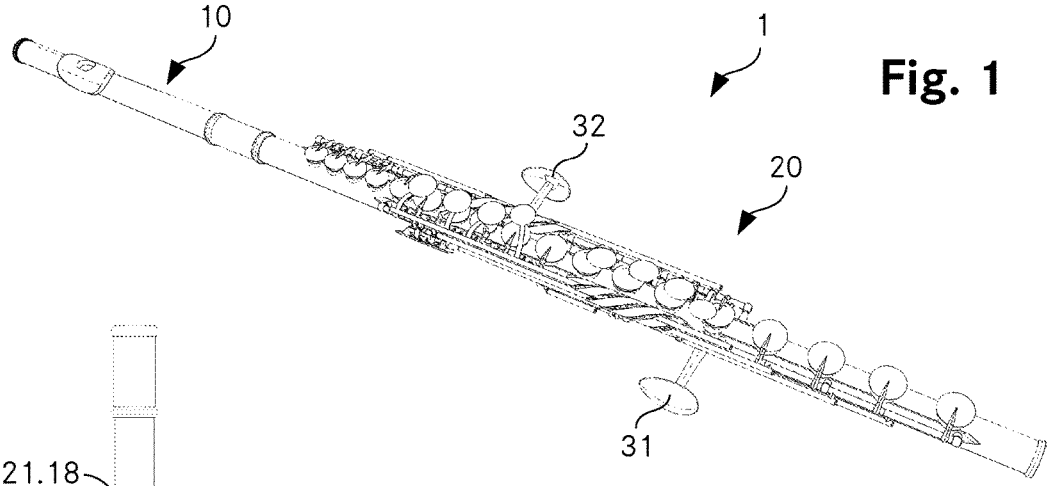
FIG. 1 An angular view of a flute according to the invention.

The FIG. 1 is an angular view of the flute. The flute 1 comprises a head joint 10 which corresponds to a known usual head joint of a concert flute and a sound tube 20 to which the head joint 10 is attached to in a conventional manner.

Figure 2:
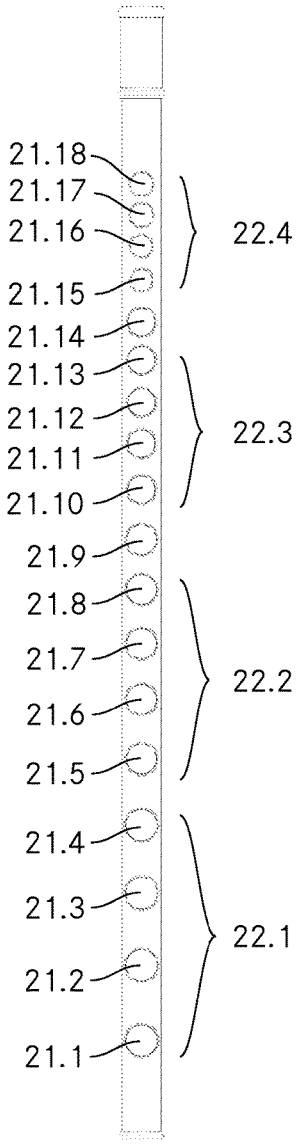
FIG. 2 a top view of the sound tube of the flute.

The FIG. 2 is a top view of the sound tube of the flute, with removed mechanical parts such as keys, pads and linkages. The sound tube has 18 tone holes 21.1 . . . 18 which are arranged essentially in a line along a top side of the sound tube 20. Their size and distance is chosen in such a way that opening a further tone hole closer to the head joint end of the sound tube 20 increases pitch by a semitone, i.e. consecutively opening tone holes, starting from the free end of the sound tube 20, allows for playing a sequence of 19 semitones. Opened sequentially, the tone holes 21.1 . . . 18 will produce the notes of an ascending chromatic scale. With 18 tone holes 21.1 . . . 18 to be opened, a fundamental register of nineteen notes is achieved.

The 18 holes 21.1-21.18 may be grouped as follows:

left-hand remote group 22.1: holes 21.1-21.4;

right-hand local group 22.2: holes 21.5-21.8;

right-hand thumb: hole 21.9;

left-hand local group 22.3: holes 21.10-21.13;

left-hand thumb: hole 21.14;

right-hand remote group 22.4: holes 21.15-21.18.

Viable hole sizes and positions, for a concert flute pitched at A=440 Hz, are given in the following table. The hole location is measured from the free end of the sound tube 20.

| hole number | hole diameter [mm] | hole location [mm] |
|---|---|---|
| 1 | 15.6 | 49.7 |
| 2 | 15.6 | 87.7 |
| 3 | 15.6 | 123.6 |
| 4 | 15.6 | 157.5 |
| 5 | 14.8 | 190.4 |
| 6 | 14.8 | 220.0 |
| 7 | 14.8 | 248.9 |
| 8 | 14.8 | 276.0 |
| 9 | 14.8 | 301.8 |
| 10 | 13.5 | 327.0 |
| 11 | 13.5 | 349.9 |
| 12 | 13.5 | 371.4 |
| 13 | 13.5 | 391.8 |
| 14 | 13.5 | 411.1 |
| 15 | 10.5 | 431.1 |
| 16 | 10.5 | 449.2 |
| 17 | 11.2 | 464.5 |
| 18 | 11.2 | 479.9 |

As shown in FIG. 1, the sound tube 20 is provided by a mechanism including keys to be operated by the fingers and thumbs of the player, pads to close the 18 tone holes and linkage mechanisms to link the keys to the pads. The mechanism is described in more detail in connection with the following Figures.

The sound tube 20 of the flute 1 is further provided with two hand supports 31, 32 for the right and left hand of the player, respectively. On a usual Boehm system concert flute, the right thumb does not have an active playing role. It serves only to prop up the instrument. The Boehm flute is supported by the player's lower jaw, the base of the left index finger, and the right thumb. In contrast, all fingers and thumbs are required to operate all keys of the flute 1 according to the invention. Accordingly, the right thumb must be liberated from its support-only role. This is accomplished by the hand supports 31, 32. Together with the player's jaw, they provide three-point support.

The hand supports 31, 32 are removably attached to the sound tube 20 by stems and feature teaspoon-shaped pads that press into the palms of the hands, directly below the little fingers. This is a place of the hand where pressure can be applied without any detriment to the dexterity of fingers or thumb. With the instrument stable between the player's jaw and the two hand supports 31, 32, all fingers and thumbs are free to play.

Figures 3A, 3B, 3C, 3D:
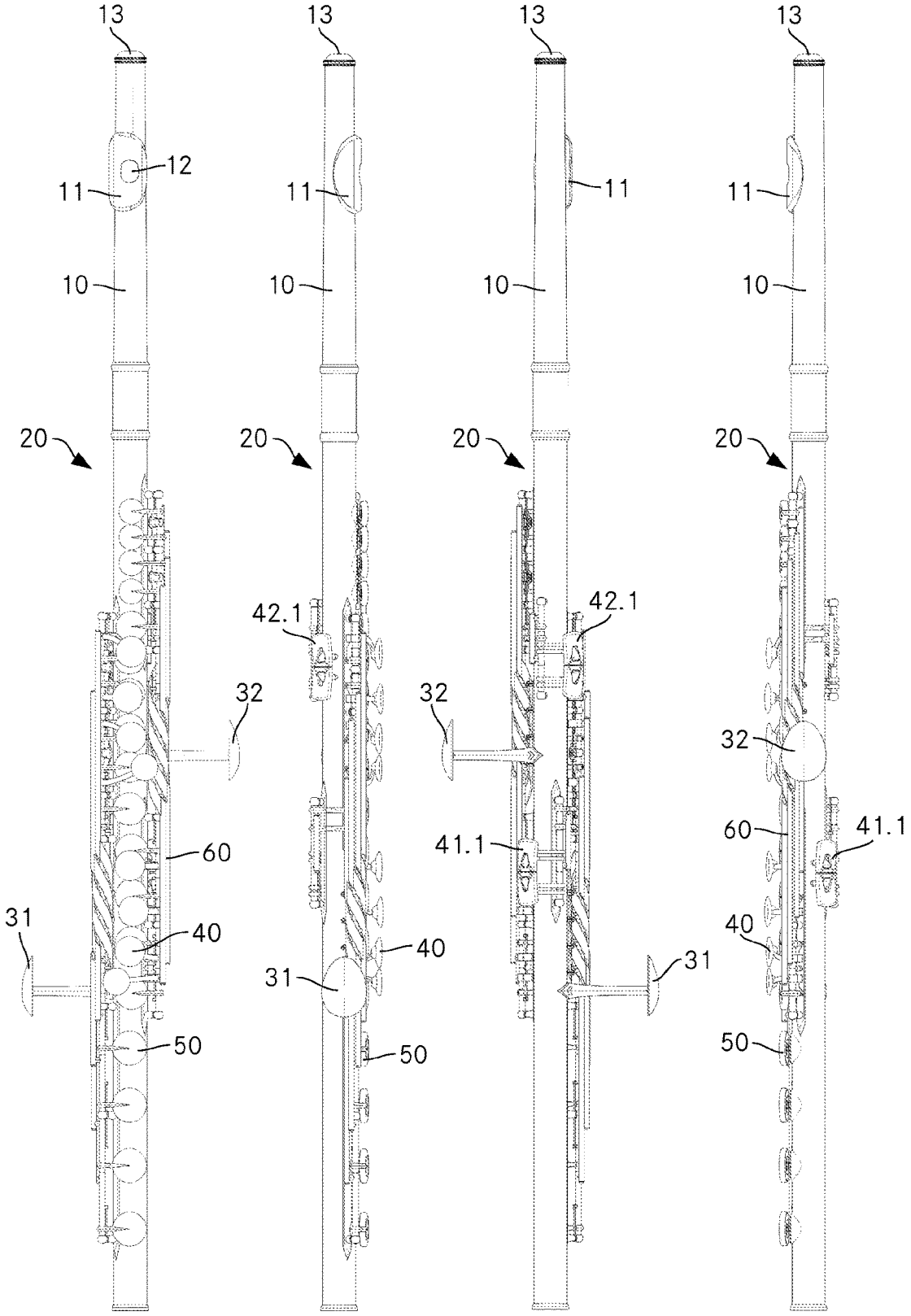
FIG. 3A a top view of the flute.
FIG. 3B a front view of the flute.
FIG. 3C a bottom view of the flute.
FIG. 3D a back view of the flute.

The FIGS. 3A-D provide different views of the flute: FIG. 3A is a top view, FIG. 3B is a front view, FIG. 3C is a bottom view, and FIG. 3D is a back view. The flute is transverse when played, essentially horizontal, with the tone-holes and pads along the top. Accordingly, the front view is essentially what the player sees when playing the flute. The right hand approaches the flute from the front, and the left hand approaches the instrument from the back.

The FIGS. 3A-D show the head joint 10 with the lip plate 11 mounted on a riser in a manner known as such. The lip plate 11 is forming the embouchure hole 12. The back end of the head joint 10 is formed by the crown 13 closing off the tube. A stopper is inserted into the tubing of the head joint 10, between the embouchure hole 12 and the crown 13.

The sound tube 20 is provided by two hand supports 31, 32 as described above as well as with the key work, including keys 40 to be contacted by the finger of the player's hands and pads 50 as well as a linkage mechanism 60 connecting the keys 40 to the pads 50. These elements are described in more detail in the following, in connection with FIGS. 4-14.

Figure 4:
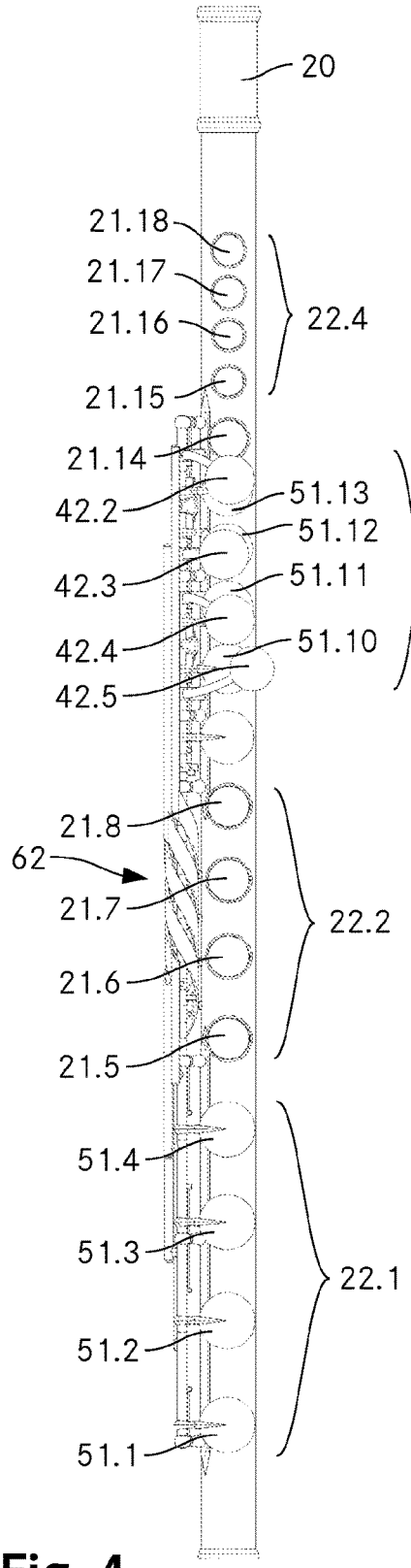
FIG. 4 a top view of the flute with attached left hand keys and pads.
Figure 5:
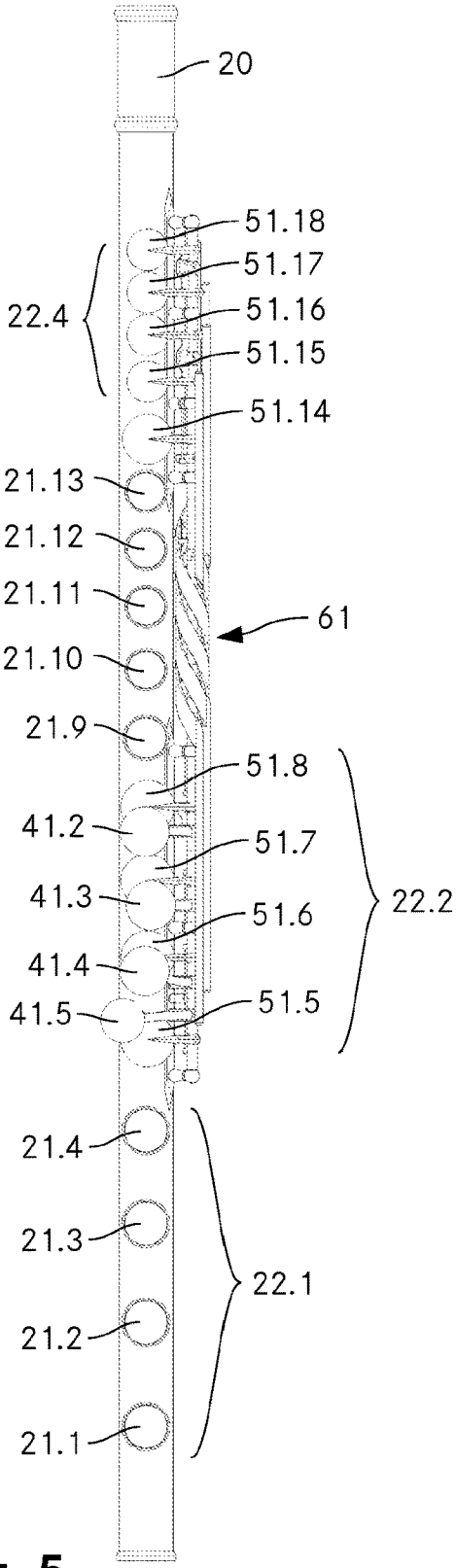
FIG. 5 a top view of the flute with attached right hand keys and pads.

The FIG. 4 is a top view of the flute with attached left hand keys and pads. The FIG. 5 is a top view of the flute with attached right hand keys and pads. Removing the keys and pads assigned to one of the player's hands allows for a better overview over the flute's mechanism.

As mentioned above, the tone holes 21.1 . . . 21.18 may be grouped into four groups 22.1 . . . 4 of four holes each as well as two thumb holes 21.9, 21.14.

The holes 21.5-21.8 of the right hand local group 22.2 are closed by respective pads 51.5-51.8, actuated by keys 41.2-41.5, where the assignment is as follows:

| hole | pad | key | finger |
|---|---|---|---|
| 21.5 | 51.5 | 41.5 (L5) | r. h. little |
| 21.6 | 51.6 | 41.4 (L4) | r. h. ring |
| 21.7 | 51.7 | 41.3 (L3) | r. h. middle |
| 21.8 | 51.8 | 41.2 (L2) | r. h. index |

The keys 41.2-41.5 are arranged close to the respective pads 51.5-51.8. Nevertheless, as shown further below, the action of the keys 41.2-41.5 is transmitted to the pads 51.5-51.8 by means of levers and a swivel axis of the linkage mechanism.

Unless already closed by the action of the right-hand thumb key 41.1 (R1; cf. FIGS. 3C, 3D), the holes 21.10-21.13 of the left hand local group 22.3 are closed by respective pads 51.10-51.13, actuated by keys 42.2-42.5, where the assignment is as follows:

| hole | pad | key | finger |
|---|---|---|---|
| 21.10 | 51.10 | 42.5 (R5) | l. h. little |
| 21.11 | 51.11 | 42.4 (R4) | l. h. ring |
| 21.12 | 51.12 | 42.3 (R3) | l. h. middle |
| 21.13 | 51.13 | 42.2 (R2) | l. h. index |

Again, the keys 42.2-42.5 are arranged close to the respective pads 51.10-51.13. Nevertheless, as shown further below, the action of the keys 42.2-42.5 is transmitted to the pads 51.10-51.13 by means of levers and a swivel axis of the linkage mechanism.

The holes 21.1-21.4 of the left hand remote group 22.1 are closed by pads 51.1-51.4, actuated by the left-hand keys 42.2-42.5, the action being transmitted by the linkage mechanism 62 including helical sections, described in more detail below. The assignment is as follows:

| hole | pad | key | finger |
|---|---|---|---|
| 21.1 | 51.1 | 42.5 (R5) | l. h. little |
| 21.2 | 51.2 | 42.4 (R4) | l. h. ring |
| 21.3 | 51.3 | 42.3 (R3) | l. h. middle |
| 21.4 | 51.4 | 42.2 (R2) | l. h. index |

Unless already closed by the action of the left-hand thumb key 42.1 (L1; cf. FIGS. 3B, 3C), the holes 21.15-21.18 of the right hand remote group 22.4 are closed by pads 51.15-51.18, actuated by the right-hand keys 41.2-41.5, the action being transmitted by the linkage mechanism 61 including helical sections, described in more detail below. The assignment is as follows:

| hole | pad | key | finger |
|---|---|---|---|
| 21.15 | 51.15 | 41.5 (L5) | r. h. little |
| 21.16 | 51.16 | 41.4 (L4) | r. h. ring |
| 21.17 | 51.17 | 41.3 (L3) | r. h. middle |
| 21.18 | 51.18 | 41.2 (L2) | r. h. index |

Figure 6:
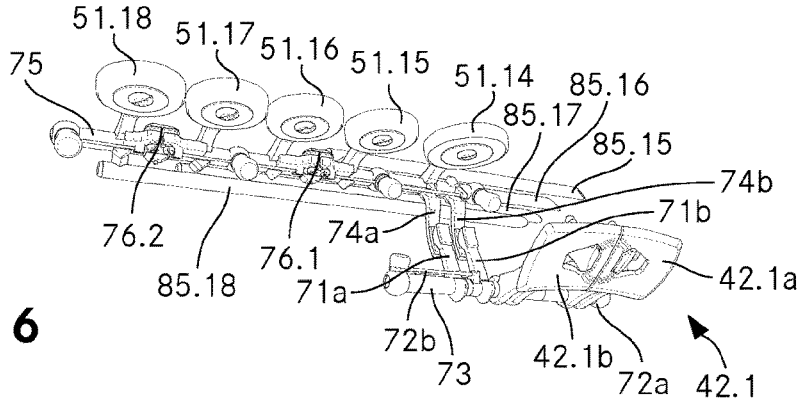
FIG. 6 an angular view of the left hand thumb key and pads of the right hand remote group.
Figure 7:
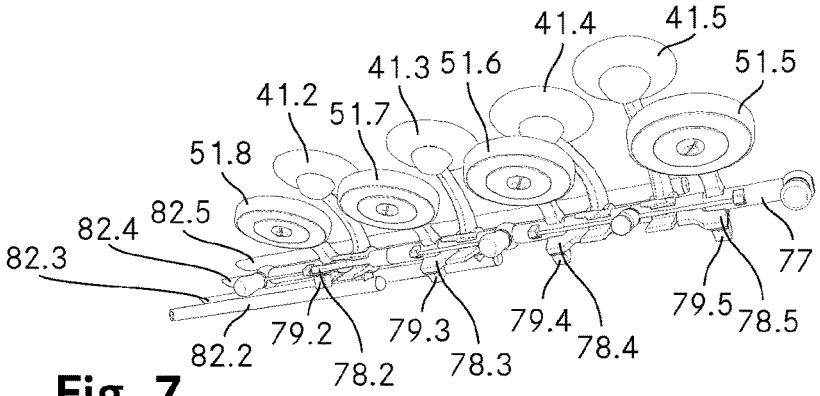
FIG. 7 an angular view of the pads of the right hand local group.
Figure 8:
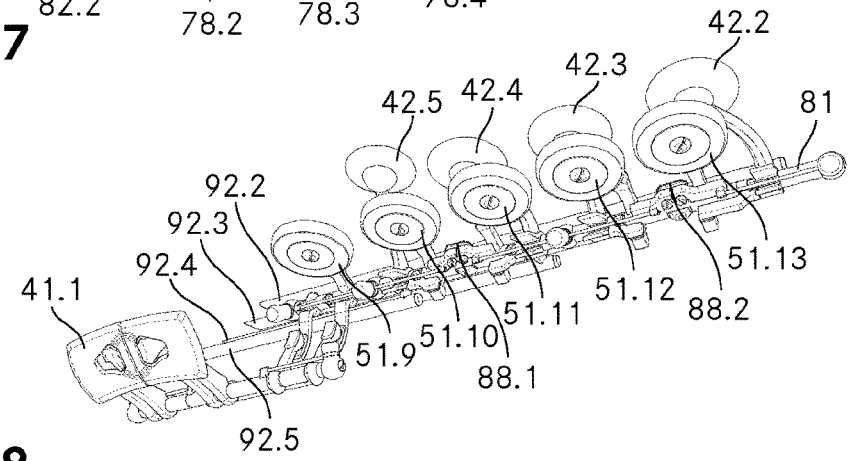
FIG. 8 an angular view of the right hand thumb key and pads of the left hand local group.
Figure 9:
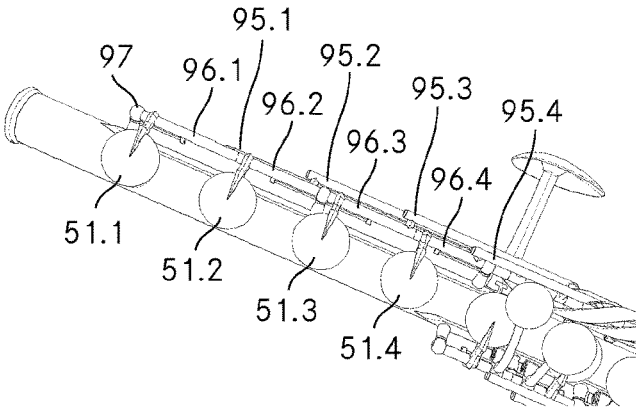
FIG. 9 an angular view of the pads of the left hand remote group.
Figure 10:
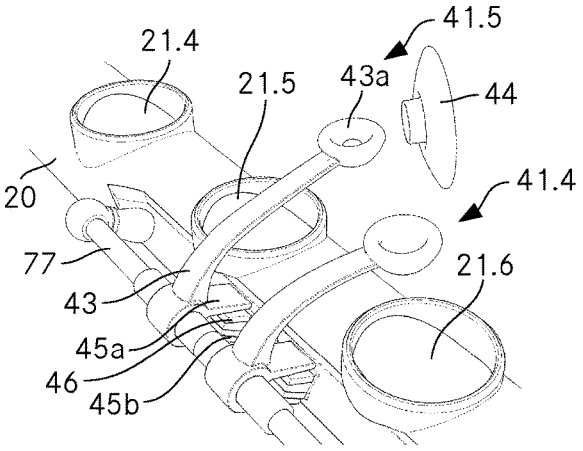
FIG. 10 an angular view showing two keys, lever stops and the installation of a key button.
Figure 11:
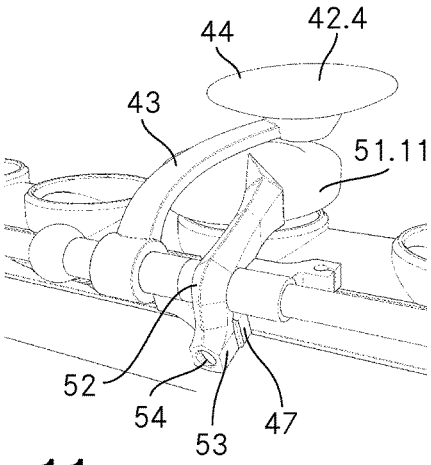
FIG. 11 an angular view showing a key with its assigned local pad and an adjustment mechanism.

The FIGS. 6-11 show details of the key work of the concert flute: FIG. 6 is an angular view of the left hand thumb key and the pads of the right hand remote group, FIG. 7 is an angular view of the pads of the right hand local group, FIG. 8 is an angular view of the right hand thumb key and the pads of the left hand local group, FIG. 9 is an angular view of the pads of the left hand remote group, and FIG. 10 is an angular view showing two keys, lever stops and the installation of a key button. FIG. 11 is an angular view showing a key with its assigned local pad and an adjustment mechanism.

The FIG. 6 shows the left hand thumb key 42.1 featuring two sections 42.1*a*, 42.1*b* as described in more detail below, in connection with FIGS. 13, 14. The two sections act on two corresponding pivotable levers 71*a*, 71*b*. In the idle state, the two sections 42.1*a*, 42.1*b* of the left hand thumb key 42.1 are held in an open position by needle springs 72*a*, 72*b*. If one of the sections 42.1*a*, 42.1*b* or both sections are depressed, the corresponding lever(s) 71*a*, 71*b* are swivelled about a holding axle 73 and act onto further levers 74*a*, 74*b* swivelling about a further holding axle 75.

The first lever 71*a* actuated by depressing the first section 42.1*a* of the left hand thumb key 42.1 is connected to the pad 51.14 for closing the hole 21.14 assigned to the left hand thumb key 42.1.

A second lever 71*b* actuated by depressing a second section 42.1*b* of the left hand thumb key 42.1 is connected to two actuating elements 76.1, 76.2 by means of an inner rotating shaft of the holding axle 75. The two actuating elements 76.1, 76.2 act onto counter elements connected to levers holding the pads 51.15, 51.16 (actuating element 76.1) and pads 51.17, 51.18 (actuating element 76.2), respectively. Accordingly, depressing the second section 42.1*b* of the left hand thumb lever 42.2 closes all four tone holes 21.15 . . . 18 simultaneously (cf. FIGS. 16D, 16F).

If the second section 42.1*b* of the left hand thumb key 42.1 is idle, these four tone holes 21.15 . . . 18 may be individually closed by the respective pads 51.15 . . . 18. In this case, the keys 21.5 . . . 8 are actuated by the fingers of the right hand. The corresponding action of keys 41.2 . . . 5 is transmitted by the linkage mechanism 61 to linkage bars 85.15 . . . 18 acting on the pads 51.15 . . . 18. The linkage mechanism 61 is described in more detail below, in connection with FIG. 12.

The FIG. 7 shows the pads 51.5 . . . 8 of the right hand local group and the keys 41.2 . . . 5 actuated by the fingers of the right hand. Both the pads 51.5 . . . 8 as well as the keys 41.2 . . . 5 are attached to levers that are pivotally supported by a holding axle 77. Springs ensure that without external forces the pads 51.5 . . . 8 are in their open position. Correspondingly, the keys 41.2 . . . 5 return to their upper, non-depressed position. The keys 41.2 . . . 5 act onto key lever extensions 78.2 . . . 5 that cooperate with pad lever extensions 79.2 . . . 5.

Furthermore, the action of the keys 41.2 . . . 5 is transmitted to linkage bars 82.2 . . . 5 belonging to the linkage mechanism 61, described in more detail below, in connection with FIG. 12.

The FIG. 8 shows the right hand thumb key 41.1, the corresponding pad 51.9, the pads 51.10 . . . 13 of the left hand local group and the keys 42.2 . . . 5 actuated by the fingers of the left hand. Again, all the pads 51.9 . . . 13 as well as the keys 42.2 . . . 5 are attached to levers that are pivotally supported by a holding axle 81. Springs ensure that without external forces the pads 51.9 . . . 13 are in their open position. Correspondingly, further springs ensure that the keys 42.2 . . . 5 return to their upper, non-depressed position even if the pads 51.10 . . . 13 are closed due to actuation of the right hand thumb key 41.1. The cooperation of the keys 42.2 . . . 5 with the assigned pads 51.10 . . . 13 is analogous to that described in connection with FIG. 7 above. Similarly, the action of the keys 42.2 . . . 5 is transmitted to linkage bars 92.2 . . . 5 belonging to the linkage mechanism 62.

Similar to the mechanism described in detail in connection with FIG. 6, a first section of the right hand thumb key 41.1 cooperates with the pad 51.9 to close the associated hole, and a second section of the right hand thumb key 41.1 cooperates with two actuating elements 88.1, 88.2 acting onto counter elements connected to levers holding the pads 51.10, 51.11 (actuating element 88.1) and pads 51.12, 51.13 (actuating element 88.2), respectively, for simultaneously closing all four tone holes of the left hand local group.

The FIG. 9 shows the pads 51.1 . . . 4 of the left hand remote group. They are actuated by linkage bars 95.1 . . . 4 of the linkage mechanism 62. They are connected to sleeves 96.1 . . . 4 that are pivotally supported on a holding axle 97. Levers holding the pads 51.1 . . . 4 are fixedly attached to the sleeves 96.1 . . . 4.

The FIG. 10 shows two keys, lever stops and the installation of a key button. The pads and corresponding elements of the key mechanism are not displayed. The Figure shows the three tone holes 21.4, 21.5, 21.6 and the two keys 41.4, 41.5 to be actuated by the ring and little finger of the player's right hand. In the following, the elements of one of the keys 41.5 are described in more detail.

The key 41.5 comprises a key lever 43 pivotally supported on the holding axle 77 and featuring a connection cup 43*a* at its free end. A key button 44 comprises a connection geometry that allows for easily connecting the key button 44 to the connection cup 43*a* of the key lever 43. The key lever 43 comprises a sleeve surrounding the holding axle 77 and ending in two plate-like radial extensions 45*a*, 45*b*. The two extensions 45*a*, 45*b* cooperate with a protrusion 46 extending radially from the sound tube 20, defining a permissible pad rotation of about 7° (this angle being the same for all pads). The protrusion 46 is provided by cork pads. Together, the protrusion 46 and the extensions 45*a*, 45*b* of the sleeve of the key lever 43 provide a stop for the key 41.5, defining the idle position as well as a maximum depressed position.

This mechanism isolates the pads from the pressure of the player's fingers, thus extending the service life of the pads, especially when the instrument is played by people exerting high forces onto the keys.

Each of the connections between a key and its local pad as well as between a key and its remote pad has its own screw adjustment. The FIG. 11 shows a key with its assigned local pad and the respective adjustment mechanism. The key 42.4 to be operated by the ring finger of the left hand inter alia controls the local pad 51.11. For that purpose, the key lever 43 features a contact plate 47 extending along the holding axle into an axial region of the pad lever 52 carrying the pad 51.11. The pad lever 52 features a base portion 53 with a screw hole accommodating an adjustment screw 54. Both the key lever 43 and the pad lever 52 are held in an open position by needle springs.

The method of adjustment is to 'back off' the screw, press the key lever 43 firmly against the stop, and then advance the screw 54 until the pad 51.11 receives just enough pressure to seal the hole. Accordingly, when the instrument is played, only the screw-adjustment pressure is transmitted to the pad 51.11. All heavy-handed excess is absorbed by the stop.

Figure 12:
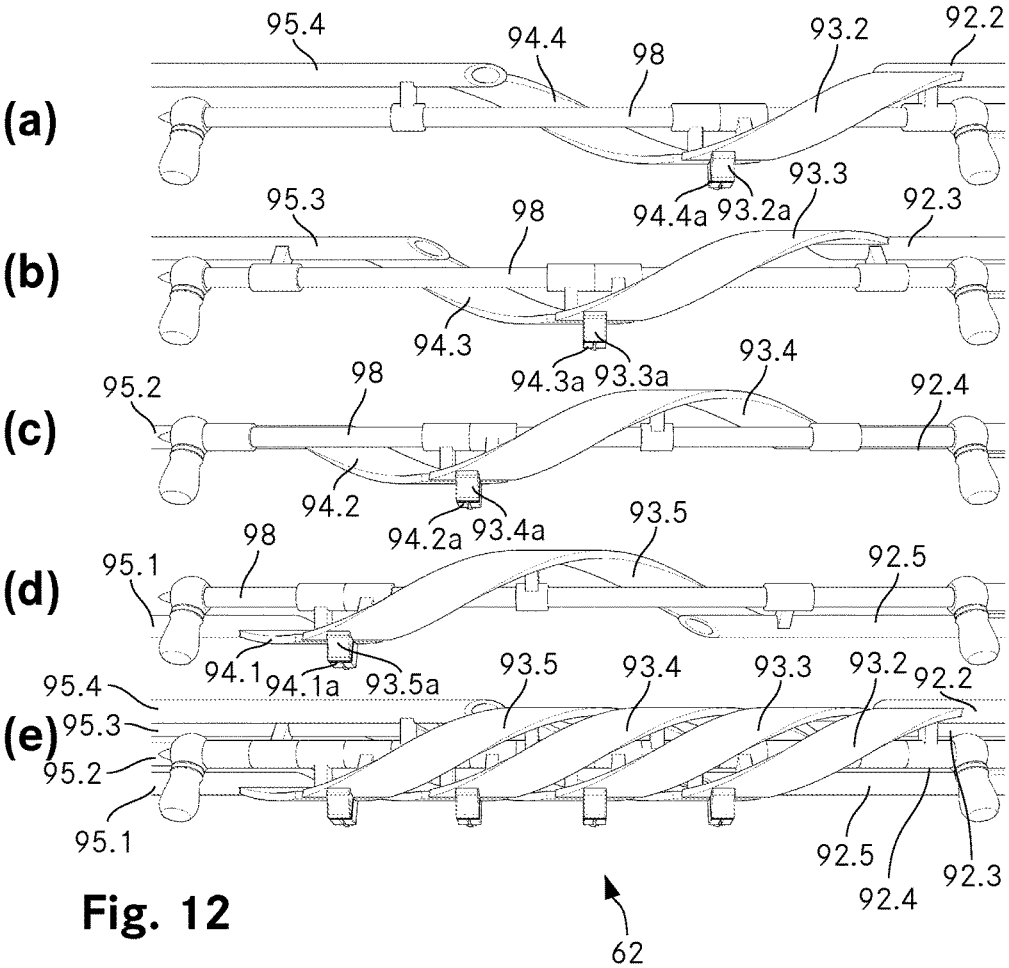
FIG. 12 a front view of a helix-shaped linkage of the flute.

The FIG. 12 (*e*) is a front view of a helix-shaped linkage of the flute. The FIGS. 12 (*a*)-(*d*) are side views of the elements of each of the four links of the linkage.

The linkage mechanism 62 connects the four keys 42.2 . . . 5 operated by the left hand with the pads 51.1 . . . 4 closing the tone holes 21.1 . . . 4 of the left hand remote group.

As mentioned before, the keys 42.2 . . . 5 are mechanically linked to the input linkage bars 92.2 . . . 5. The pads 51.1 . . . 4 are mechanically linked to the output linkage bars 95.1 . . . 4. A first link is provided by the following elements:

- an input linkage bar 92.2 on the input side of the linkage 62;
- a first helical section 93.2 that is connected to the linkage bar 92.2, running around about 160°, featuring a contact element 93.2*a* at its free (output) end;
- a second helical section 94.4 that features another contact element 94.4*a* at its free (input) end, interacting with the contact element 93.2*a* of the first helical section 93.2; the second helical section running around about 200°;
- an output linkage bar 95.4 connected to the second helical section 94.4.

All the elements are pivotally supported on a central axle 98. For that purpose, short sleeves fixedly connected to the linkage bars 92.2, 95.4 and the helical sections 93.2, 94.4 are threaded onto the axle, having a plain bearing between the inside surface of the sleeve and the outside surface of the central axle 98. The length of the sleeves is chosen such that the added length of all sleeves exactly matches the free length of the axle between two posts attached to the sound tube, supporting the central axle 98.

The further links are designed analogously. The following table gives an overview of the involved components and the main characteristics of the four links:

| input linkage bar | first helical section | contact element | angle | second helical section | contact element | angle | output linkage bar |
|---|---|---|---|---|---|---|---|
| 92.2 | 93.2 | 93.2a | 160 | 94.4 | 94.4a | 200 | 95.4 |
| 92.3 | 93.3 | 93.3a | 205 | 94.3 | 94.3a | 155 | 95.3 |
| 92.4 | 93.4 | 93.4a | 250 | 94.2 | 94.2a | 110 | 95.2 |
| 92.5 | 93.5 | 93.5a | 295 | 94.1 | 94.1a | 65 | 95.1 |

At their interacting surfaces, the contact elements 93.2 . . . 5*a*, 94.1 . . . 4*a* constituting clutches coupling the input of the linkage with the output, feature a thin cork pad. The contact elements 94.1 . . . 4*a* of the second helical sections 94.1 . . . 4 comprise a screw hole accommodating an adjustment screw. The helical sections are designed and arranged in such a way that the screw heads lie in a row parallel to the longitudinal axis of the sound tube and can be easily reached for adjusting the linkage 62.

Compared to usual linkages, the torsional stiffness of the helical linkage mechanisms 61, 62 is reduced. Due to the lever stops described above, in connection with FIG. 10, the maximum force acting onto the input linkage bars is limited, such that the reduced torsional stiffness does not create actual problems when operating the instrument. The screw adjustment at the junction in the helical linkage is the same as for the local hole described above. Correct adjustment ensures that the helical linkage will only carry the light load required to seal the pad: nothing more and nothing less. Excess pressure is absorbed by the stop and not transmitted along the linkage.

Figure 13A:
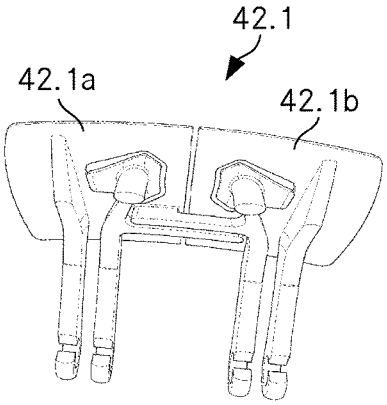
FIG. 13A, B the components of a divided thumb key of the flute.

The FIGS. 13A, B show the components of a divided thumb key of the flute. The FIGS. 14A-D show the different operation states of the divided thumb key.

As described above, the divided thumb key, FIGS. 13, 14 show the left hand thumb key 42.1, allows for either closing a local tone hole, closing four remote tone holes or both, depending on what sections are actuated. Namely, depressing the first section 42.1*a* closes the local tone hole 21.14, whereas depressing the second section 42.1*b* closes the four tone holes 21.15 . . . 18.

Figure 13B:
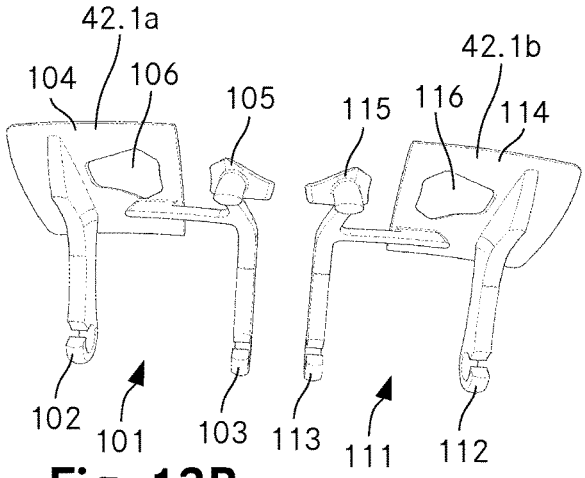

Essentially, the divided thumb key 42.1 consists of two unitary elements 101, 111 (cf. FIG. 13B). These elements comprise two extensions 102, 103; 112, 113 each for pivotably supporting the elements 101, 111 on an axle. A first extension 102, 112 is connected to a plate-like element 104, 114 providing an essentially planar actuating surface and featuring a through hole 106, 116. A second extension is connected to an auxiliary element 105, 115 having a ramp shaped free end. The two unitary elements 101, 111 are combined in such a way that the ramp shaped free ends of the auxiliary elements 105, 115 penetrate the through holes 106, 116 of the respective other unitary element.

Figure 14A:
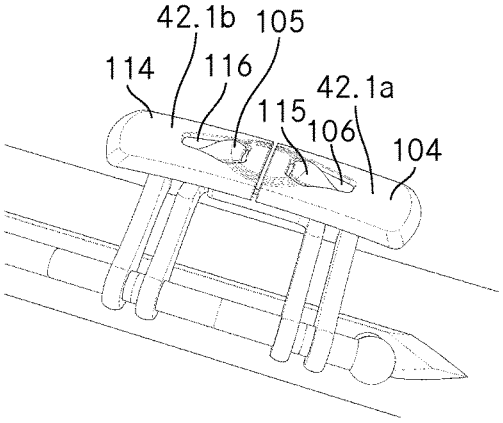
FIG. 14A-D the different operation states of the divided thumb key.

The FIG. 14A shows the idle state of the divided thumb key 42.1. The two planar actuating surfaces of the plate-like elements 104, 114 form together an essentially planar actuating surface, both surfaces lying in a common plane. The ramp shaped free ends of the auxiliary elements 105, 115 lie behind the plane defined by the actuating surfaces.

Figure 14B:
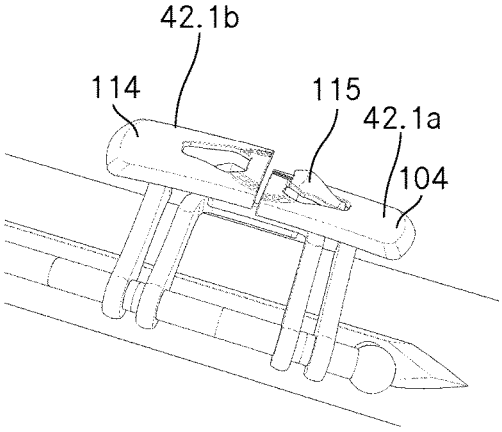
Figure 14C:
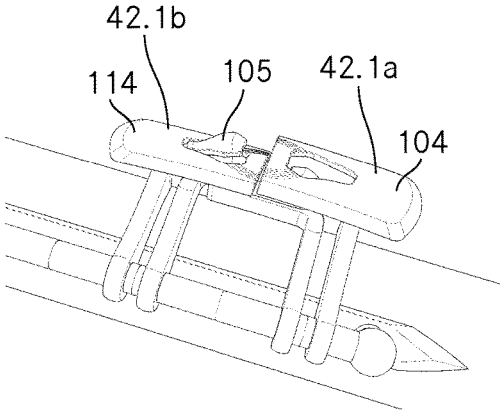

The FIGS. 14B, 14C show a state where one of the two actuating surfaces is depressed. Clearly, the auxiliary element 105, 115 of the other unitary element 101, 111 penetrates the through hole 106, 116 of the depressed actuating surface, the elevation of the auxiliary element 105, 115 above the actuating surface rising in a direction towards the other plate-like element 114, 104.

Sliding from one actuating surface to the other is greatly enhanced by the ramp, as the sliding movement along the actuating surface leads to gradual depression of the other unitary element 101, 111. As soon as the junction between the two actuating surfaces is reached, the other actuating surface is already depressed and the other section of the thumb key is brought into alignment with the presently contacted section before the thumb reaches it. This ensures a smooth sliding transfer to the other actuating surface.

Figure 14D:
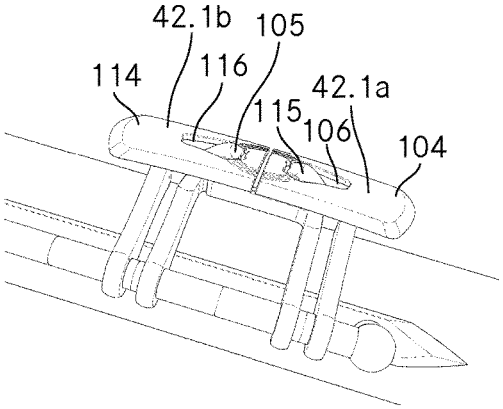

The FIG. 14D shows a state where both actuating surfaces are depressed, e. g. by contacting the divided thumb key 42.1 in a central section. This is the default kind of contacting the thumb lever when playing in the fundamental and $2^{nd}$ register of the described concert flute.

Figure 15:
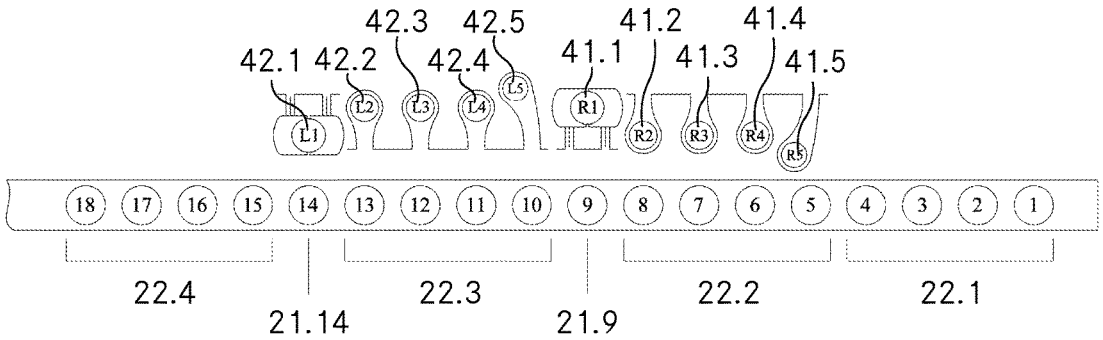
FIG. 15 a schematic representation of the flute for explaining the nomenclature of keys and holes.

The FIG. 15 is a schematic representation of the flute for explaining the nomenclature of keys and holes. Briefly restated, the holes are grouped as follows:

holes 1-4: left hand remote group 22.1;
holes 5-8: right hand local group 22.2;
hole 9: right hand thumb hole 21.9;
holes 10-13: left hand local group 22.3;
hole 14: left hand thumb hole 21.14; and
holes 15-18: right hand remote group 22.4.

The ten finger contacts are denoted as R1-R5 and L1-L5, respectively. The assignment is as follows:

right hand: R1 (thumb)—41.1; R2 (index)—41.2; R3 (middle)—41.3; R4 (ring)—41.4; R5 (little)—41.5 left hand: L1 (thumb)—42.1; L2 (index)—42.2; L3 (middle)—42.3; L4 (ring)—42.4; L5 (little)—42.5.

The graphical representation of FIG. 15 and the short indications of the holes and finger contacts are used in FIGS. 16, 17 and in the following description of the fingering scheme of the inventive concert flute.

The FIGS. 16A-F are schematic representations showing the impact of actuating a certain key of the flute.

Figure 16A:
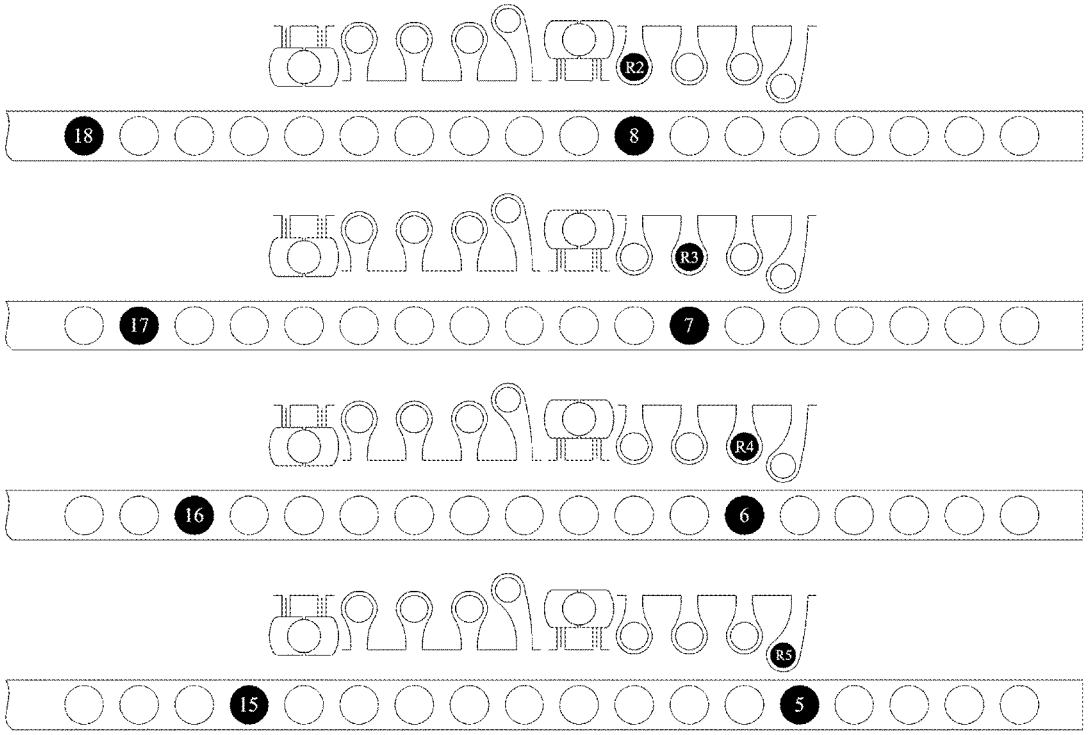
FIG. 16A-F schematic representations showing the impact of actuating a certain key of the flute.
Figure 16B:
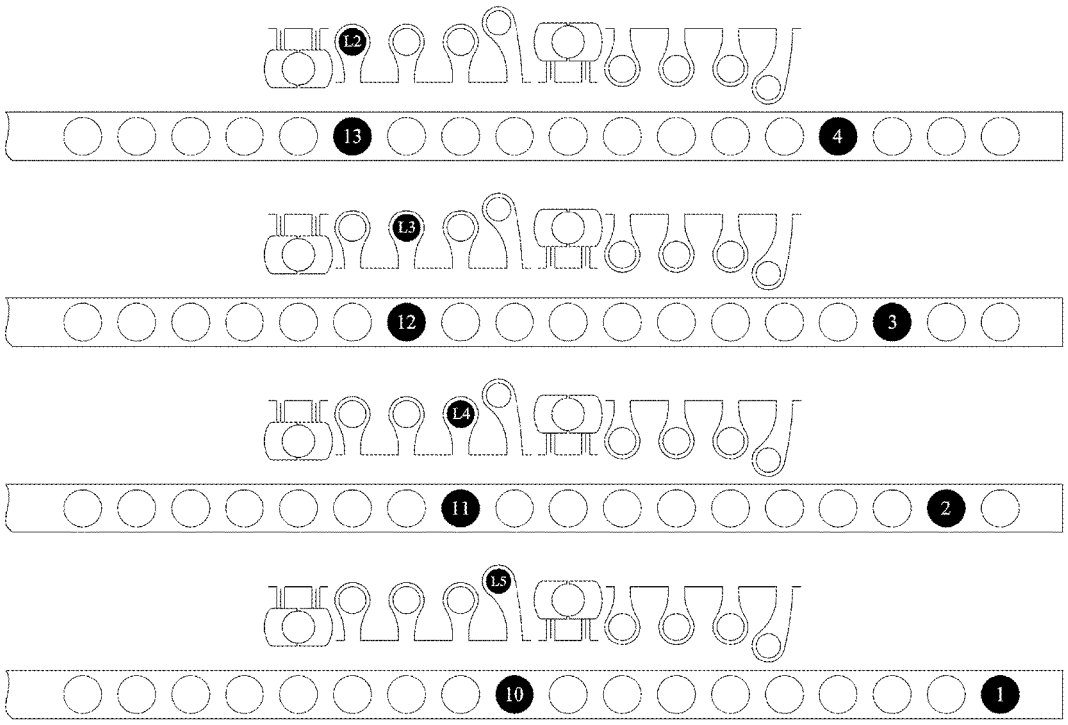

As shown in FIGS. 16A, B actuating any of the right hand finger contacts R2-R5 or left hand finger contacts L2-L5 closes two tone holes, namely the associated tone hole of the respective local group and the associated tone hole of the respective remote group.

Figure 16C:
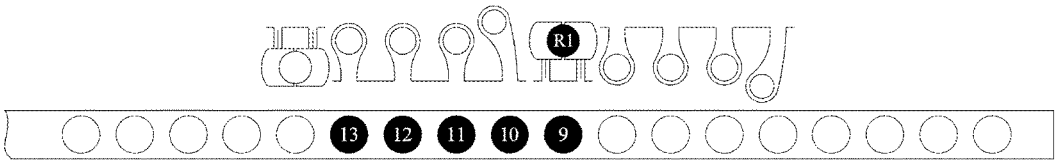

As shown in FIG. 16C, actuating a central portion of the right hand thumb key R1 (i. e. both sections of the thumb key simultaneously) closes the right hand thumb hole 9 as well as the tone holes 10-13 of the left hand local group.

Figure 16D:
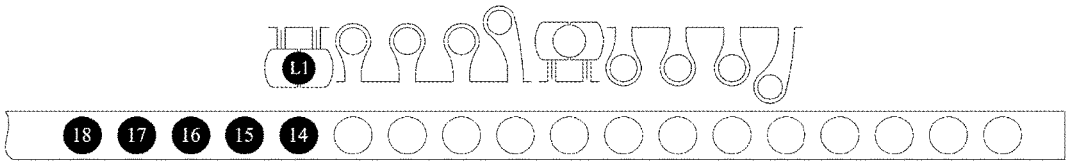

As shown in FIG. 16D, actuating a central portion of the left hand thumb key L1 (i. e. both sections of the thumb key simultaneously) closes the left hand thumb hole 14 as well as the tone holes 15-18 of the right hand remote group.

These are the contacts that are used when playing in the fundamental and $2^{nd}$ register of the concert flute.

Figure 16E:
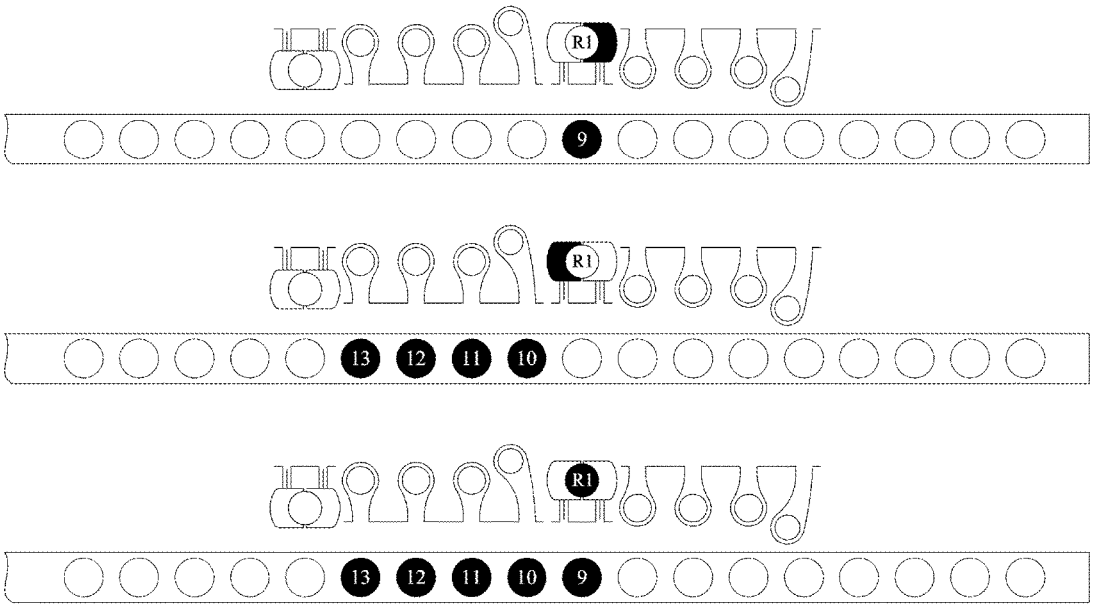
Figure 16F:
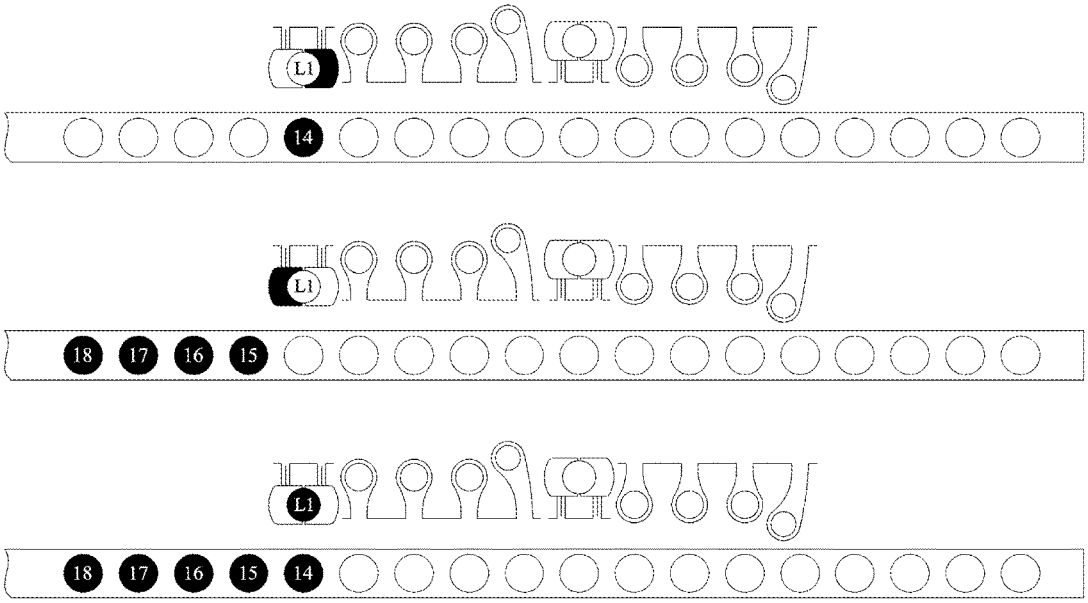

The FIGS. 16E, F relate to further options that are used for so called "vented harmonics": In all modern woodwind instruments, the playing range is extended upward by the use of what may be termed "vented harmonics": higher notes facilitated by the opening of vent holes placed to discourage the production of lower partials. To support a third register of vented harmonics, the two functions of each thumb contact R1, L1 are divided, in order to allow for opening or closing the left and right thumb holes 9, 14 independently of other actions.

Within a divided right-hand thumb assembly R1 (FIG. 16E):

the lower part acts only upon the right thumb hole 9;
the upper part acts upon the tone holes 10-13 of the left hand local group 22.3.

The central contact activates both parts and therefore acts upon all five holes 9-13.

Within the divided left-hand thumb assembly L1 (FIG. 16F):

the lower part acts only upon the left thumb hole 14;
the upper part acts upon the tone holes 15-18 of the right hand local group 22.4.

The central contact activates both parts and therefore acts upon all five holes 14-18.

Figure 17A:
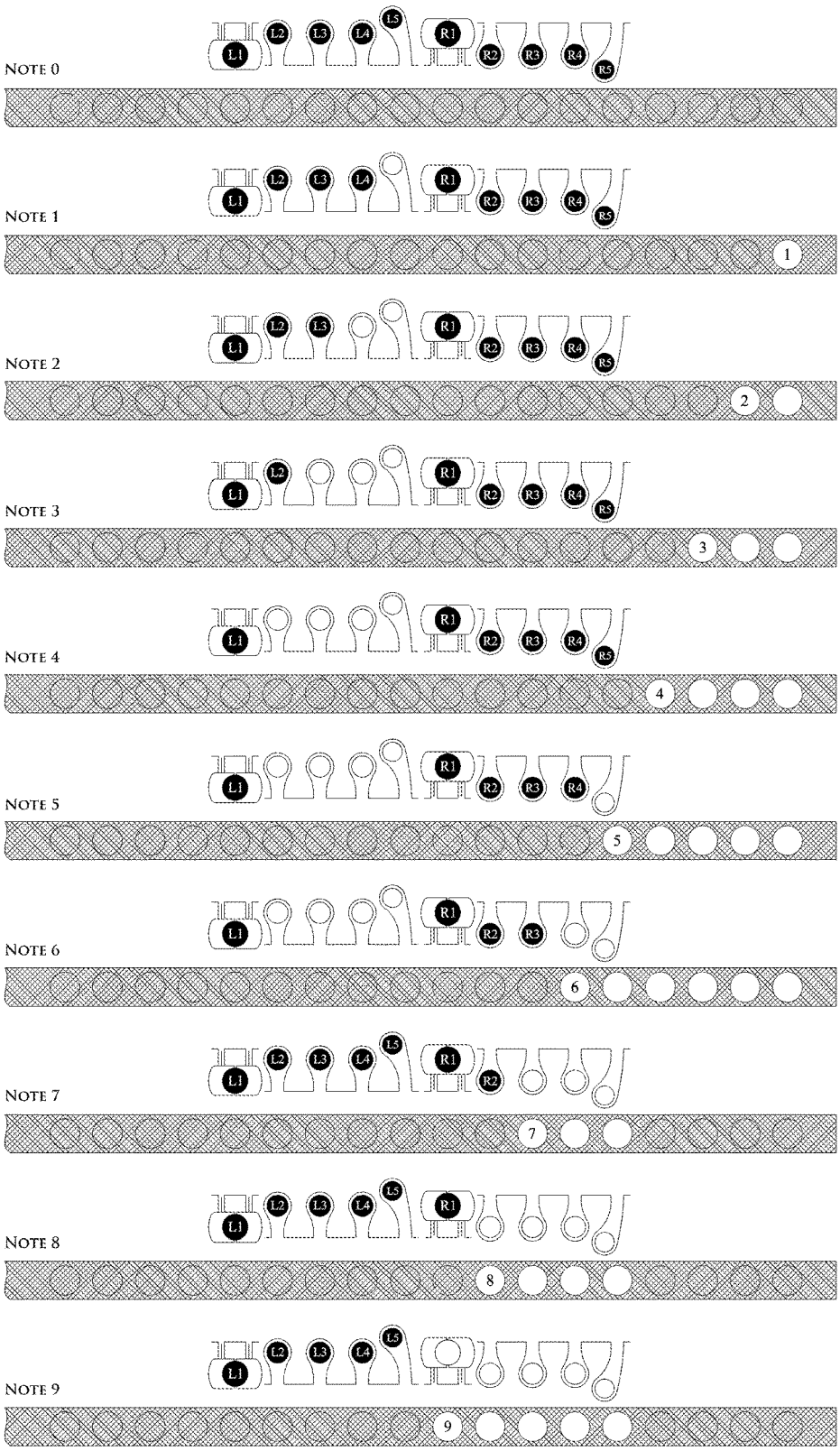
FIG. 17A, B schematic representations of the fingerings of the fundamental register.
Figure 17B:
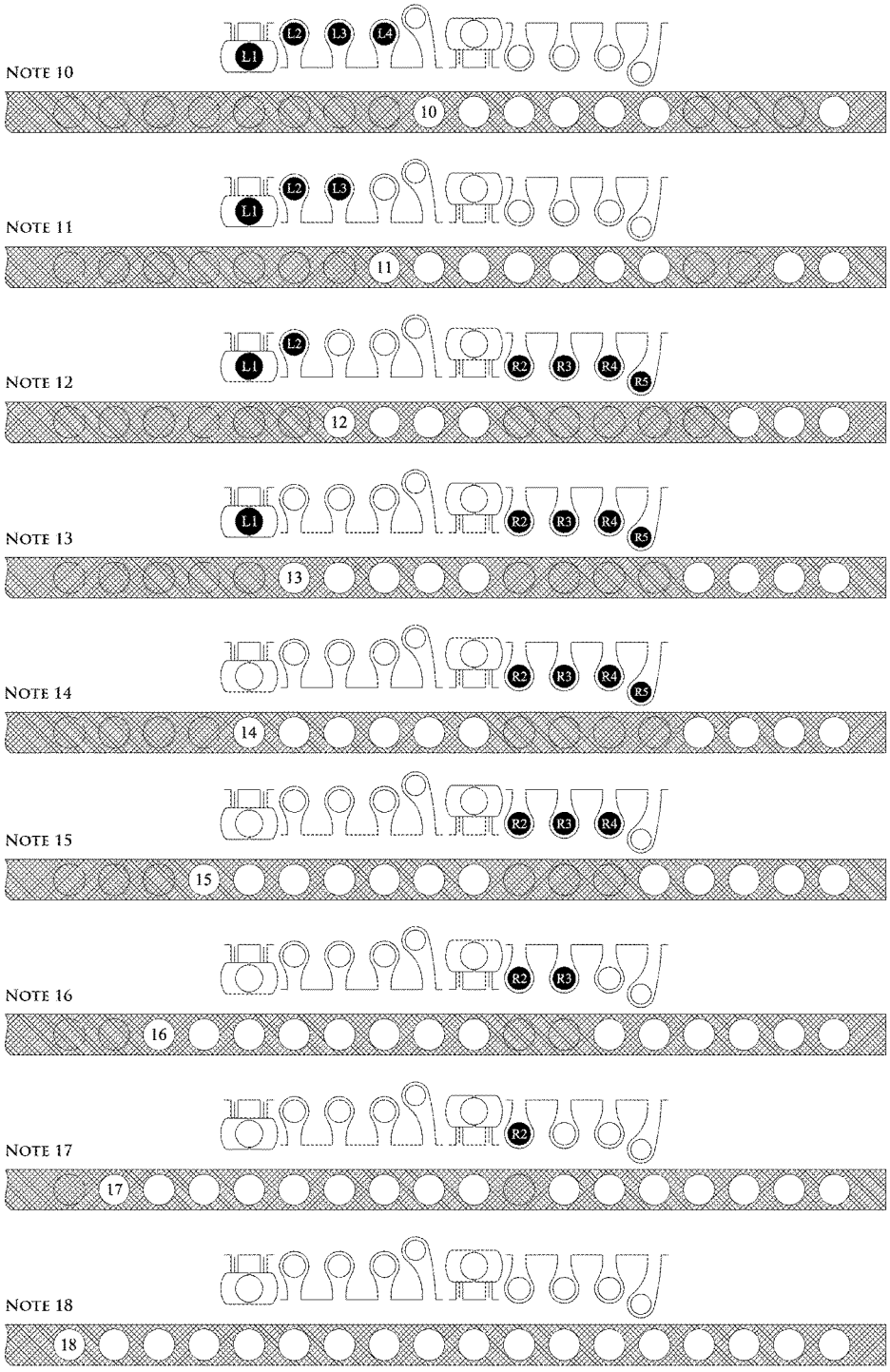

The FIGS. 17A, B are schematic representations of the nineteen fingerings of the fundamental register with their corresponding hole closure patterns. In the case of a concert flute, these same fingerings may be used in the $2^{nd}$ register, where by appropriately blowing the $2^{nd}$ harmonic is generated, which means that the pitch of the notes of the $2^{nd}$ register are an octave higher than those of the fundamental register.

It is to be noted that the partial thumb fingerings shown in connection with FIGS. 16E, F are not required for the fundamental register and play no part in the basic fingering regime. Therefore, in the fingering diagrams shown in FIG. 17A, B only the simple 'L1' and 'R1' appear.

To keep note numbers and hole numbers in alignment, the instrument's lowest note, having no holes open, has been designated 'Note 0'. This note is obtained if all finger contacts are actuated. Starting from note 0 (all keys depressed) the chromatic sequence of the fundamental register is obtained as follows:

a. releasing the four fingers L5, L4, L3, L2 of the left hand: notes 1-4;
b. releasing the four fingers R5, R4, R3, R2 of the right hand: notes 5-8;
c. actuating the left hand finger contacts L2-L5 again (this can be done already for notes 7, 8) and releasing the right hand thumb R1: note 9;
d. releasing the four fingers L5, L4, L3, L2 of the left hand: notes 10-13;
e. actuating the right hand finger contacts R2-R5 again (this can be done already for notes 12, 13) and releasing the left hand thumb contact L1: note 14;
f. releasing the four fingers R5, R4, R3, R2 of the right hand: notes 15-18.

Accordingly, the fingering regime foresees close co-operation between the fingers of one hand and the thumb of the opposite hand. Within the chromatic scale, fingerings are simple and sequential. More importantly, from an ergonomic standpoint, the transition from any note to any other note is achieved without contrary motion of the fingers on one hand or the other. By extension, this type of forked fingering is eliminated from all melody-making, regardless of musical key. Only when the range is extended into a third register (third octave in the case of a flute) will such 'intra-hand' contrary motion be required.

As an example, note 9 may correspond to G4, which means that note 0 is A#3 and note 18 is E5. Useful second register notes will start with D#5 (an octave higher than note 5 of the fundamental register). Accordingly, there is a certain overlap and therefore a certain freedom about where to switch to the $2^{nd}$ register. This provides additional possibilities to the player which allows for facilitating finger technique or improving intonation and/or sound of the played notes. In the context of the described concert flute, the normal fingerings for D#5 and E5 are those in the fundamental register, and the second register fingerings are primarily used in trills or fast passages in connection with further second register notes. Together, the fundamental and $2^{nd}$ register which have the simple fingering scheme provide a range of A#3-E6.

In summary, the fingering regime uses improved co-operation between fingers and thumbs to extend the capability of the fingers. Specifically, the fingers of the left hand control two groups of tone holes, widely separated, with the right thumb serving to remove the higher group from play. Conversely, the fingers of the right hand control two groups of tone holes, widely separated, with the left thumb serving to remove the upper group from play. The practical effect is that finger technique learned for one part of the scale may reapplied at another, with acoustical and ergonomic advantages delivered by the extended fundamental range.

The invention is not restricted to the described embodiment. In particular, details of the key work mechanism may be embodied differently. As mentioned above, the purely mechanical key work may be partially replaced by hydraulic or pneumatic links or by signal links and local actuators for the pads. Instruments having an electronic tone generator controlled by finger contacts that follow the inventive fingering regime are possible as well.

Furthermore, the invention is not restricted to concert flutes or flute-like instruments. As an example, the invention is very beneficial in connection with clarinets as they have a wider fundamental register (perfect $12^{th}$ instead of an octave). Comparted to the complicated key work and fingering of usual Boehm or Oehler clarinets the inventive fingering regime simplifies the mechanism as well as the fingering.

Having a fundamental register of a perfect $12^{th}$, all 19 fingerings are required to span this interval, and so no finger is left free to operate a register key. Nevertheless, in connection with the concert flute described above divided thumb key arrangements have been presented, in which upper and lower halves may be operated independently. In the case of an inventive clarinet they may be used inter alia to control a register key (or two or more register keys, if needed).

Over the full range of an inventive acoustic woodwind instrument fingerings that require the use of only the upper half of either of the thumb keys may be avoided: All fingerings involve either no thumb key, both sections or only the lower half (which controls the pad for closing the assigned thumb hole). Accordingly, the upper half of the thumb keys may be used for operating the register key (i. e. a pad closing a register hole). Pads for a plurality of register holes (e. g. in the case of bass or contra-bass clarinets) may be selectively closed by automatic mechanisms, depending on the position of other keys or pads, similar to solutions known in connection with e. g. bass clarinets or saxophones.

Nevertheless, in the following a possible solution for soprano clarinets (such as B-flat or A clarinets) is discussed.

The chalumeau register (fundamental register) of an inventive acoustic clarinet will require all nineteen fingerings, to span the range E3 to A#4, but for acoustical reasons the clarion register ($2^{nd}$ register) will be limited to fourteen semitones, B4 to C6, similar to a Boehm clarinet. As described above, the fingering scheme foresees to press the left thumb key (both sections) for the first fourteen notes (0-13) and to free the left thumb key for the last five (14-18). Accordingly, in the case of a clarinet, the functions of the divided left thumb key may be altered to support management of a register hole, as follows:

For the left thumb, the ability to close the four-hole-series without closing the local thumb hole (by actuating the upper section only) is sacrificed.

For the chalumeau register, the upper thumb position becomes the default position, closing both the local thumb hole and the adjacent four-hole-series.

For the clarion register, the thumb moves down to the central position, maintaining the five closures but opening the register hole.

For the altissimo register ($3^{rd}$ register), the thumb moves down to the lower position, releasing the four-hole-series but keeping the local thumb hole closed and the register hole open.

Although the mechanical linkages will require modification, the stepless transition described in connection with FIGS. 13, 14 may be preserved.

In summary, it is to be noted that the invention creates a musical instrument that allows for fluid playing irrespective of key. It is further noted that the invention is one from which a broad family of musical instruments may be derived: instruments which, across their first and second registers and therefore over much of their playing ranges, share both basic fingerings and advanced technique.

The invention claimed is:

1. Musical instrument comprising a mouthpiece and an elongated body connected to the mouthpiece, the elongated body comprising a plurality of finger contacts, wherein a) the plurality of finger contacts comprises a first set of contacts that are arranged in such a way that they may be simultaneously contacted by the little finger, ring finger, middle finger and index finger of the right hand;

b) the plurality of finger contacts comprises a second set of contacts that are arranged in such a way that they may be simultaneously contacted by the little finger, ring finger, middle finger and index finger of the left hand;

c) the plurality of finger contacts comprises a first thumb contact that may be contacted by the thumb of the right hand simultaneously with the finger contacts of the first set of contacts;

d) the plurality of finger contacts comprises a second thumb contact that may be contacted by the thumb of the left hand simultaneously with the finger contacts of the second set of contacts;

e) the musical instrument comprises a tone generator controlled by the plurality of finger contacts, in such a way that a first set of successive half tones are generated under control of the second set of contacts when the first thumb contact is operated;

a second set of successive half tones are generated under control of the first set of contacts when the second thumb contact is operated, a third set of successive half tones are generated under control of the second set of contacts when the first thumb contact is freed; and a fourth set of successive half tones are generated under control of the first set of contacts when the second thumb contact is freed.

2. Musical instrument as recited in claim 1, wherein in a given register a pitch range defined by the fourth set of successive half tones is above a pitch range defined by the third set of successive half tones, which is above a pitch range defined by the second set of successive half tones, which is above a pitch range defined by the first set of successive half tones.

3. Musical instrument as recited in claim 1, wherein additional half tone steps being provided by the operation of each of the first and the second thumb contacts.

4. Musical instrument as recited in claim 3, wherein a pitch of a first of the additional half tone steps is between the second and third set of successive half tones and wherein a pitch of a second of the additional half tone steps is between the third and the fourth set of successive half tones.

5. Musical instrument as recited in claim 1, wherein the elongated body being a sound tube, wherein the mouthpiece is a woodwind mouthpiece for generating a vibrating air column in the sound tube and wherein the plurality of finger contacts are linked to pads for covering tone holes in the sound tube.

6. Musical instrument as recited in claim 5, wherein the sound tube comprising at least 18 tone holes the closure of which is operated by the first set of contacts, the second set of contacts, the first thumb contact and the second thumb contact, wherein each finger contact of the first set of contacts and each finger contact of the second set of contacts operates two tone holes, depending on a state of the second thumb contact or the first thumb contact, respectively, and wherein the first thumb contact and the second thumb contact operate a further tone hole each.

7. Musical instrument as recited in claim 6, wherein a first set of tone holes corresponding to the first set of successive half tones is arranged below a second set of tone holes corresponding to the second set of successive half tones, which is arranged below a third set of tone holes corresponding to the third set of successive half tones, which is arranged below a fourth set of tone holes corresponding to the fourth set of successive half tones.

8. Musical instrument as recited in claim 7, wherein the first set of contacts is arranged in a region essentially corresponding to a position of the second set of tone holes and wherein the second set of contacts is arranged in a region essentially corresponding to a position of the third set of tone holes.

9. Musical instrument as recited in claim 5, wherein the first thumb contact is linked to the pads in such a way that operating the first thumb contact simultaneously closes all tone holes of the third set of tone holes independent of the actuation of the second set of contacts, and wherein the second thumb contact is linked to the pads in such a way that operating the second thumb contact simultaneously closes all tone holes of the fourth set of tone holes, independent of the actuation of the first set of contacts.

10. Musical instrument as recited in claim 5, wherein at least one of the first and second thumb contact comprises two sections that may be operated together or independently by the associated thumb, wherein operating one of the two sections allows for closing the tone holes of a set of half tones associated with the thumb contact without simultaneously closing a further single tone hole associated with the thumb contact.

11. Musical instrument as recited in claim 10, wherein the two sections are constituted by two elements that are depressible independently of each other, the elements providing an essentially planar actuating surface, wherein in an idle state of both sections the actuating surfaces of the two sections lie in a common plane.

12. Musical instrument as recited in claim 11, wherein the actuating surfaces of the elements feature an opening each and wherein the first of the elements is connected to a first auxiliary section associated with the opening of the second of the elements and wherein the second element is connected to a second auxiliary section associated with the opening of the first element, wherein the first auxiliary section penetrates the opening of the second element when the second element is depressed and the first element is idle and wherein the second auxiliary section penetrates the opening of the first element when the first element is depressed and the second element is idle.

13. Musical instrument as recited in claim 12, wherein the auxiliary sections are ramp-shaped, an elevation of the auxiliary sections rising in a direction towards the element connected to the respective auxiliary section.

14. Musical instrument as recited in claim 12, wherein the first element and first auxiliary section, and the second element and second auxiliary section, respectively, are unitary components.

15. Musical instrument as recited in claim 11, wherein the first element and the second element are pivotable about a common axis.

16. Musical instrument as recited in claim 5, having a linkage mechanism for mechanically transmitting an operation of at least two of the plurality of finger contacts to at least two of the pads for covering tone holes, wherein the linkage mechanism comprises at least two linkage bars having a helix-shaped section, the helix-shaped section of a first of the at least two linkage bars and the helix-shaped section of a second of the at least two linkage bars being intertwined.

17. Musical instrument as recited in claim 16, wherein the at least two linkage bars each comprise a first linear section and a second linear section collinear with the first linear section, the first linear section neighbouring the respective finger contact and the second linear section neighbouring the respective pad, the helix-shaped section being arranged in between the first and the second linear section, wherein the first linear section of the first linkage bar is parallel to the first linear section of the second linkage bar and the second linear section of the first linkage bar is parallel to the second linear section of the second linkage bar.

18. Musical instrument as recited in claim 17, comprising a central bar, the first and second linear sections of the at least two linkage bars being pivotably attached to the central bar, the helix-shaped section of the at least two linkage bars running around the central bar.

19. Musical instrument as recited in claim 16, wherein the helix-shaped section of at least one of the linkage bars comprising at least two linkage components joined by an adjustable screw connection.

20. Musical instrument as recited in claim 16, wherein the first linear section comprising a limiting stop for limiting a transmission of an actuating force to the helix-shaped section.

21. Musical instrument as recited in claim 1, wherein a plurality of sensors is assigned to the plurality of finger contacts in such a way that first signals are generated representing the actuation of the finger contacts and in that the tone generator is controlled by the first signals.

22. Musical instrument as recited in claim 1, comprising a wind controller mouthpiece generating second signals representing the air-controlled operation of the musical instrument, wherein the tone generator is a synthesizer that is controlled by the first and second signals.

23. Musical instrument as recited in claim 1, comprising two hand supports extending from the elongated body, the hand supports allowing for supporting the elongated body by the two hands of a player, in such a way that all ten fingers of the player may independently actuate the plurality of finger contacts.

24. Musical instrument as recited in claim 23, wherein the hand supports comprising a contact piece to be pressed into a palm of an associated hand of the player.

* * * * *